US007081017B2

(12) United States Patent
Shuey et al.

(10) Patent No.: US 7,081,017 B2
(45) Date of Patent: Jul. 25, 2006

(54) USB ELECTRICAL CONNECTOR

(75) Inventors: Joseph B. Shuey, Camp Hill, PA (US); Timothy W. Houtz, Camp Hill, PA (US); Dean E. Geibel, New Cumberland, PA (US)

(73) Assignee: FCI Americas Technology, Inc., Reno, NV (US)

( * ) Notice: Subject to any disclaimer, the term of this patent is extended or adjusted under 35 U.S.C. 154(b) by 47 days.

(21) Appl. No.: 10/894,743

(22) Filed: Jul. 19, 2004

(65) Prior Publication Data

US 2006/0014431 A1 Jan. 19, 2006

(51) Int. Cl.
*H01R 13/648* (2006.01)

(52) U.S. Cl. ..... 439/607; 439/609

(58) Field of Classification Search ..... 439/607–610, 439/939

See application file for complete search history.

(56) References Cited

U.S. PATENT DOCUMENTS

| | | | | |
|---|---|---|---|---|
| 5,637,015 | A | 6/1997 | Tan et al. | 439/607 |
| 5,738,544 | A | 4/1998 | Davis | 439/607 |
| 5,797,770 | A | 8/1998 | Davis et al. | 439/607 |
| D418,480 | S | 1/2000 | Yeh | D13/147 |
| 6,113,428 | A * | 9/2000 | Yeh | 439/609 |
| 6,139,367 | A | 10/2000 | Yeh | 439/609 |
| 6,155,872 | A | 12/2000 | Wu | 439/541.5 |
| 6,162,089 | A | 12/2000 | Costello et al. | 439/541.5 |
| 6,165,014 | A | 12/2000 | Kao et al. | 439/607 |
| 6,166,892 | A | 12/2000 | Wu | 361/79 |
| 6,183,300 | B1 | 2/2001 | Belopolsky et al. | 439/607 |
| 6,238,244 | B1 | 5/2001 | Yang | 439/607 |
| 6,273,757 | B1 | 8/2001 | David et al. | 439/607 |
| 6,364,707 | B1 * | 4/2002 | Wang | 439/607 |
| D465,768 | S | 11/2002 | Zhu et al. | D13/147 |
| 6,540,563 | B1 * | 4/2003 | Hu et al. | 439/676 |
| 6,688,915 | B1 * | 2/2004 | Moriwake et al. | 439/607 |

* cited by examiner

*Primary Examiner*—Michael C. Zarroli
(74) *Attorney, Agent, or Firm*—Harrington & Smith, LLP

(57) ABSTRACT

An electrical connector including a housing; electrical contacts connected to the housing; an outer shield connected to the housing; and at least one inner shield mounted along a portion of a front side of the housing. The inner shield includes a general C shaped substantially unvarying and uniform front end, and two legs extending reward from the front end. Each leg comprises a rear end with a portion which extends into the housing to attach the rear end to the housing. The front end of the inner shield is not directly mechanically attached to a front of the outer shield.

22 Claims, 27 Drawing Sheets

USB ELECTRICAL CONNECTOR

BACKGROUND OF THE INVENTION

1. Field of the Invention

The present invention relates to an electrical connector and, more particularly, to an electrical connector having an inner shield.

2. Brief Description of Prior Developments

U.S. Pat. No. 6,273,757 discloses a shielded Universal Serial Bus (USB) electrical connector with inner shielding contacts mounted into a rear end of the housing. The inner shielding contacts have lateral wings which are received in slots in the rear end of the outer shield and subsequently captured in the slots when a rear end of the outer shield is closed over the rear end of the housing. The inner shielding contacts do not extend along the front of the housing.

U.S. Pat. No. 5,797,770 discloses a shielded Universal Serial Bus (USB) electrical connector with an inner shielding shell mounted into a rear end of the housing. The inner shell is merely mounted to the housing and is not mounted to the outer shield. A spring finger of the outer shield contacts the inner shielding shell. The inner shielding shell does not extend along the front of the housing.

U.S. Pat. No. 6,139,367 discloses a shielded USB electrical connector with inner shells mounted to the front of the housing and the front of the outer shield. The inner shells need to be attached to the housing after the outer shell is attached to the housing in order to attach the front of the inner shells to the front of the outer shell.

There is a desire to provide a shielded USB electrical connector with an inner shield mounted onto the front of the housing without having to directly attach the front end of the inner shield to a front end of the outer shield. There is a desire to insert USB inner shields (already attached to the USB housing) into a rear end of an outer shield without having to subsequently attach front ends of the USB inner shields to a front end of the outer shield.

SUMMARY OF THE INVENTION

In accordance with one aspect of the present invention, an electrical connector is provided including a housing; electrical contacts connected to the housing; an outer shield connected to the housing; and at least one inner shield mounted along a portion of a front side of the housing. The inner shield includes a general C shaped substantially unvarying and uniform front end, and two legs extending reward from the front end. Each leg comprises a rear end with a portion which extends into the housing to attach the rear end to the housing. The front end of the inner shield is not directly mechanically attached to a front of the outer shield.

In accordance with another aspect of the present invention, an electrical connector is provided comprising a housing; electrical contacts connected to the housing; an outer shield connected to the housing; and at least one inner shield mounted along a portion of a front side of the housing. The inner shield comprises a general C shaped front end and two legs extending reward from the front end. Each leg comprises a rear end with a mounting section for attaching the rear end to the housing. A first one of the legs comprises laterally outward projecting latch sections at the rear end of the first leg which extend into holes in the outer shield to electrically and mechanically connect the inner shield to the outer shield.

In accordance with another aspect of the present invention, an electrical connector is provided comprising a housing; electrical contacts connected to the housing; an outer shield connected to the housing; and at least one inner shield mounted along a portion of a front side of the housing. The inner shield comprises a general C shaped substantially unvarying and uniform front end and two legs extending reward from the front end. Each leg comprises a rear end with a projection which extends into the housing to attach the rear end to the housing. A first one of the legs comprises laterally outward projecting latch sections at the rear end of the first leg which extend into holes in the outer shield to electrically and mechanically connect the inner shield to the outer shield.

In accordance with one method of the present invention, a method of assembling an electrical connector is provided comprising inserting electrical contacts into a housing; mounting an inner shield along a portion of a front side of the housing, wherein the inner shield comprises a general C shaped front end and two legs extending reward from the front end; inserting the housing, with the inner shield attached to the housing, into a rear end of an outer shield; and attaching snap-lock latches, on rear end lateral sides of the inner shield, into holes in lateral sides of the outer shield to mechanically and electrically attach the inner shield to the outer shield without directly attaching a front end of the inner shield to a front end of the outer shield.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENTS

Figure 1:
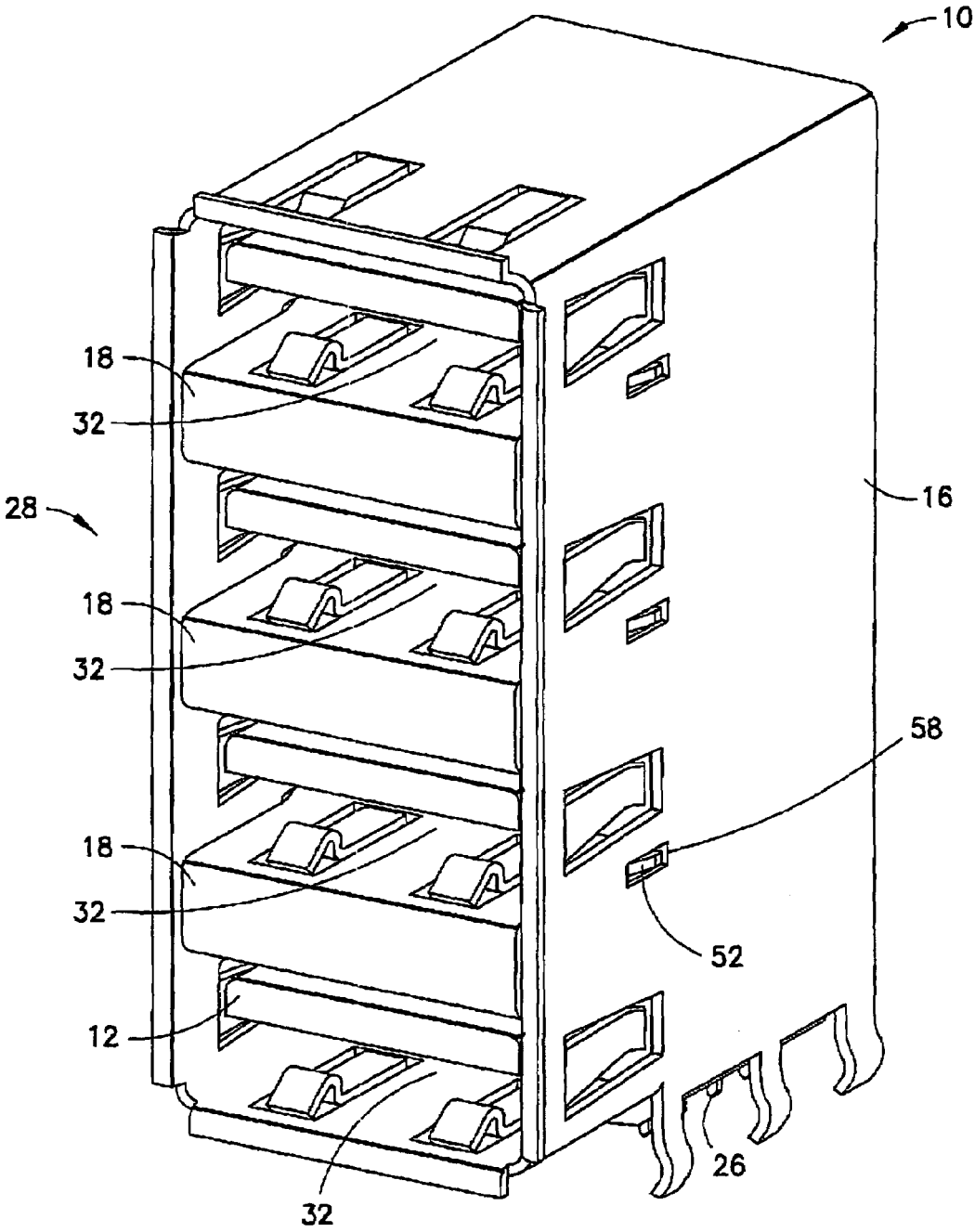
FIG. 1 is a perspective view of an electrical connector incorporating features of the present invention.
Figure 3:
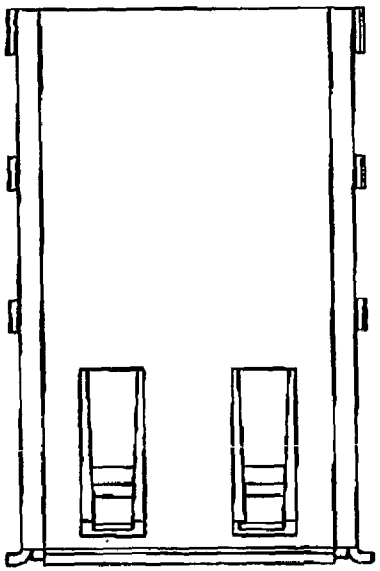
FIG. 3 is a top plan view of the electrical connector shown in FIG. 1.
Figure 2:
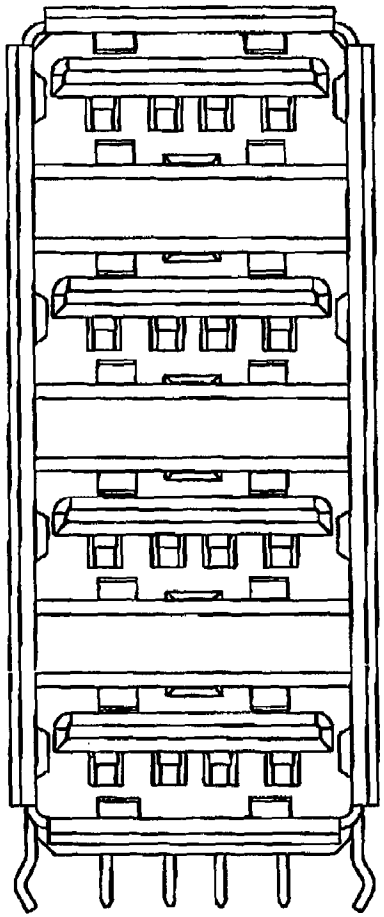
FIG. 2 is a front side view of the electrical connector shown in FIG. 1.
Figure 5:
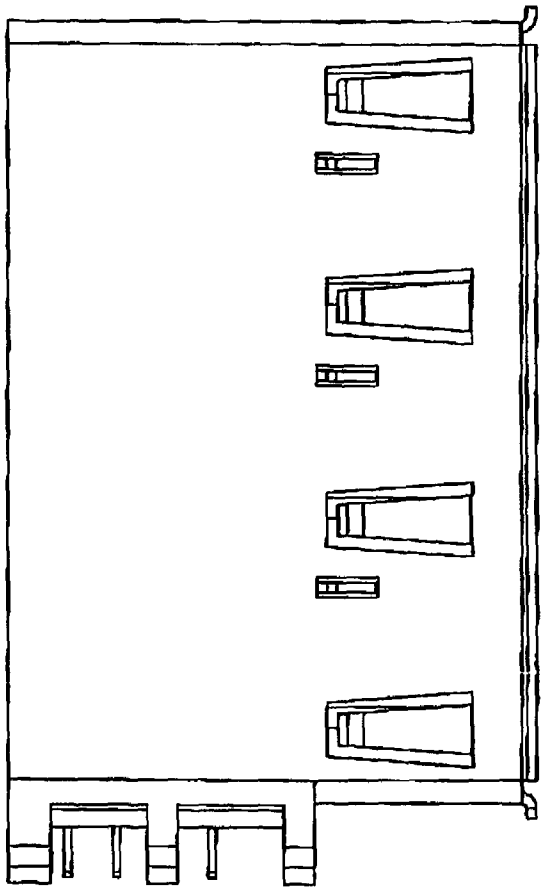
FIG. 5 is a left side view of the electrical connector shown in FIG. 1.
Figure 4:
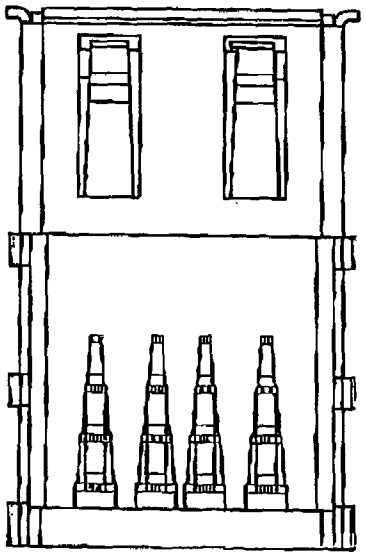
FIG. 4 is a bottom plan view of the electrical connector shown in FIG. 1.
Figure 7:
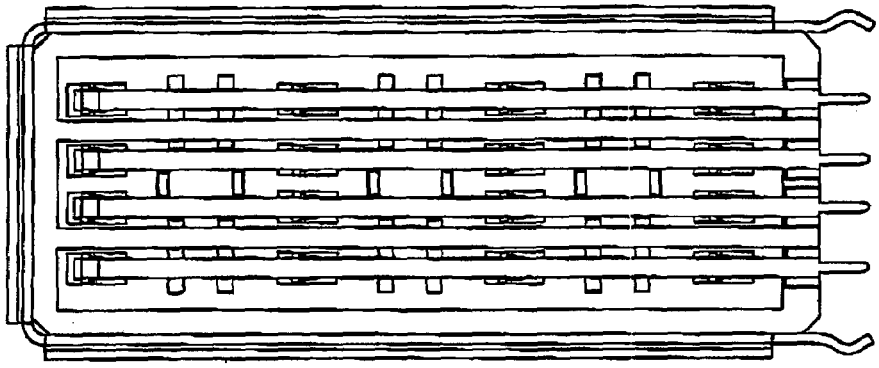
FIG. 7 is a rear side view of the electrical connector shown in FIG. 1.
Figure 6:
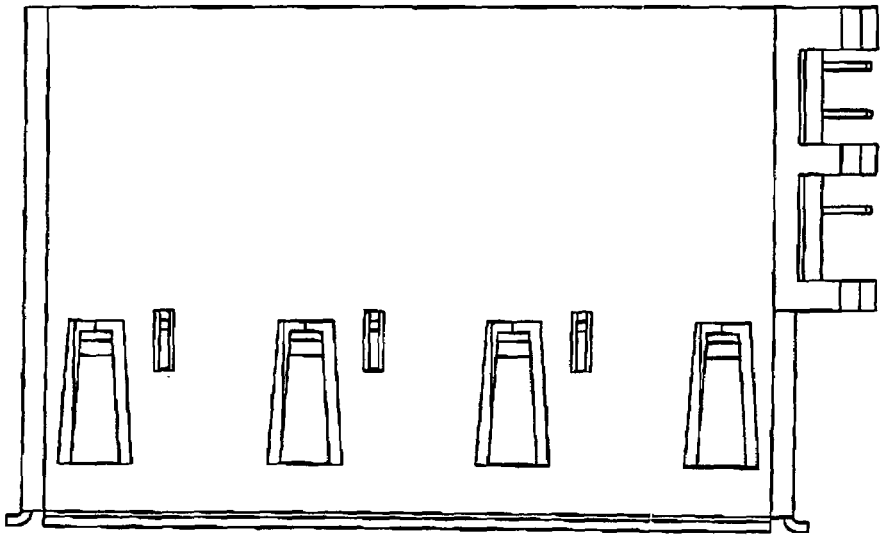
FIG. 6 is a right side view of the electrical connector shown in FIG. 1.

Referring to FIG. 1, there is shown a perspective view of an electrical connector 10 incorporating features of the present invention. Although the present invention will be described with reference to the exemplary embodiments shown in the drawings, it should be understood that the present invention can be embodied in many alternate forms of embodiments. In addition, any suitable size, shape or type of elements or materials could be used.

FIGS. 2–7 show elevational and plan views of all six sides of the connector 10. The connector 10 comprises a bottom end 26 which is adapted to be connected to an electronic component, such as a printed circuit board. The connector 10 comprises a front side 28 which is adapted to receive a plurality of individual USB plug connectors (not shown). In the embodiment shown, the connector 10 is adapted to receive four USB plug connectors in a general stacked configuration. However, features of the present invention could be used in other types of electrical connectors and could be used with a multiple USB socket electrical connector having USB plug receiving areas located adjacent each other as an alternative or in addition to the vertical stacked configuration shown. For example, features of the present invention could be used in a 2-by-X USB electrical connector having two side-by-side columns of two or more (X) USB plug receiving areas (such as 2-by-2, or 2-by-3, or 2-by-4, etc.).

Figure 8:
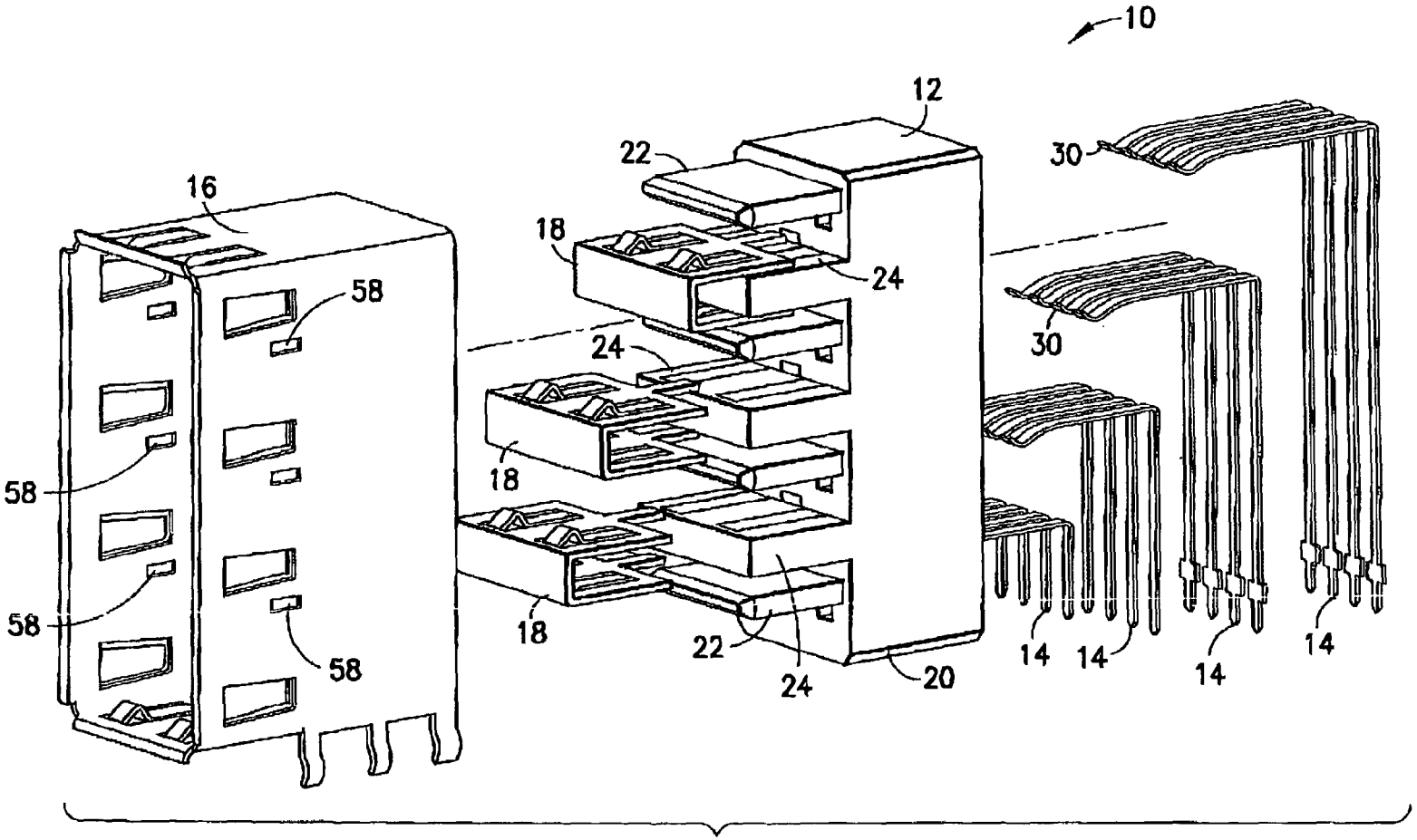
FIG. 8 is an exploded perspective view of the electrical connector shown in FIG. 1.

Referring also to FIG. 8, the electrical connector 10 generally comprises a housing 12, electrical contacts 14, an outer shield 16 and inner shields 18. The housing 12 is preferably a one-piece molded plastic or polymer member. However, in alternate embodiments, the housing could be comprised of more than one member. The housing 12 generally comprises a main section 20, contact support shelves 22, and inner shield support shelves 24. FIGS. 10–16 show perspective, plan and elevational views of all six sides of the housing 12. The main section 20 comprises a relatively open rear side which is adapted to house the vertical sections of the electrical contacts 14. The bottom ends of the electrical contacts 14 extend outward from the bottom end of the main section 20. The main section 20 also comprises holes. The holes extend through the main section to bottom sides of the contact support shelves 22. The contact support shelves 22 comprises contact grooves or channels which the upper legs of the electrical contacts 14 are located in. The deflectable contact sections 30 of the electrical contacts 14 extend downward from the bottom sides of the contact support shelves 22. Front ends of the contact sections 30 can be preloaded against portions of the contact support shelves 22. The contacts are preferably free floating in the rear part of the housing between the holes in the main section 20 and the bottom side of the main section. The bottom ends of the contacts 14 can go straight into a printed circuit board without an intermediary device between the contacts in the rear part of the housing and the printed circuit board. In an alternate embodiment, any suitable type of housing could be provided. In addition, any suitable type of electrical contacts could be provided.

Figure 9:
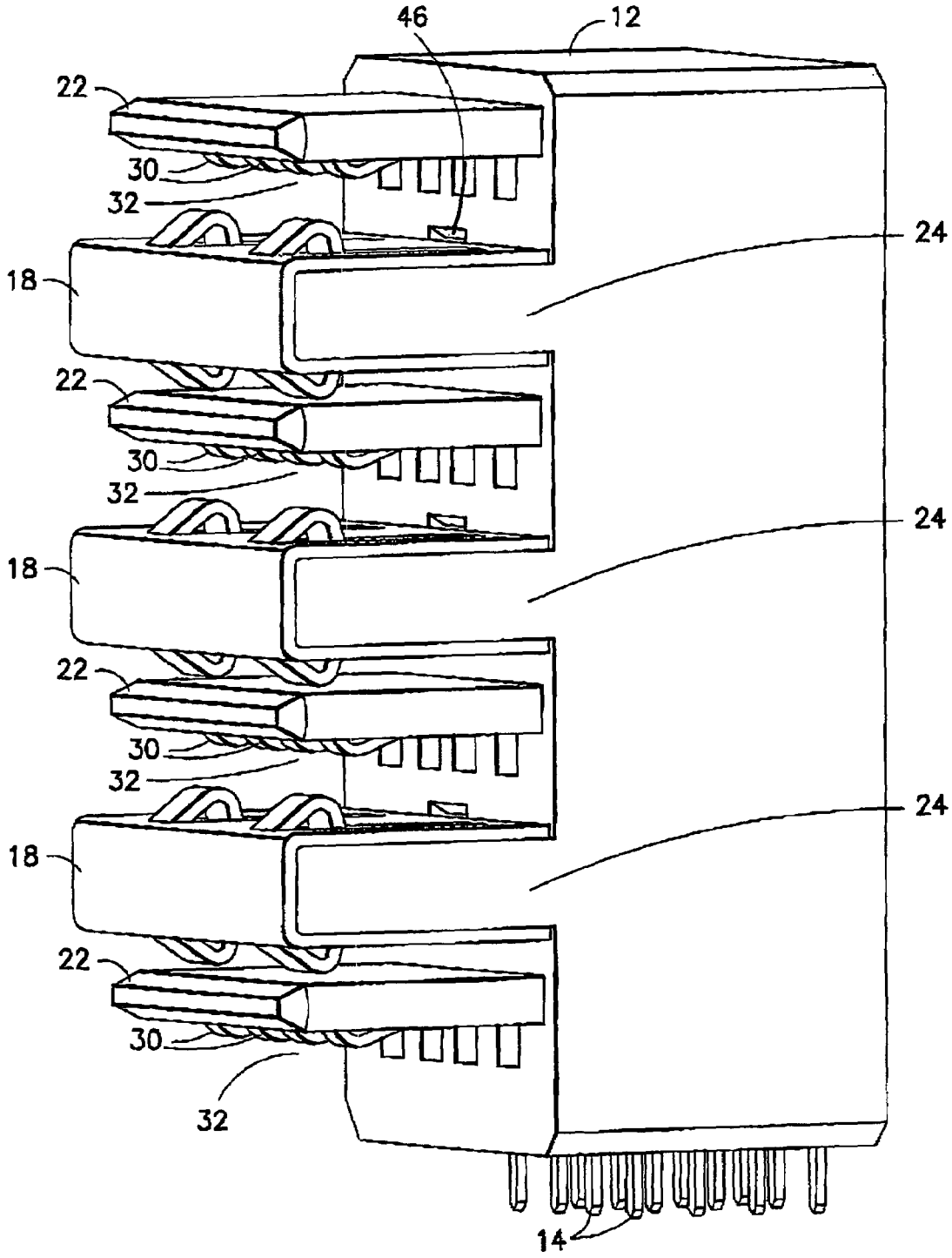
FIG. 9 is a perspective view of a subassembly of components of the electrical connector shown in FIG.
Figure 11:
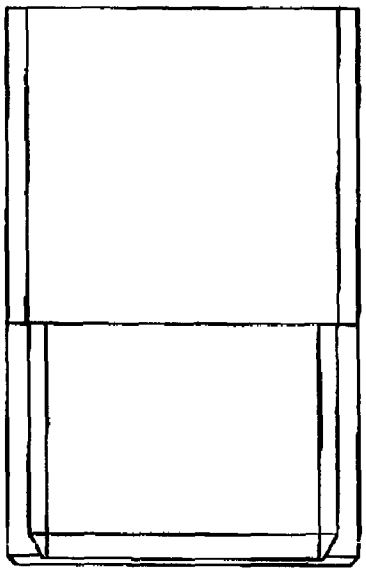
FIG. 11 is a top plan view of the housing shown in FIG. 10.
Figure 10:
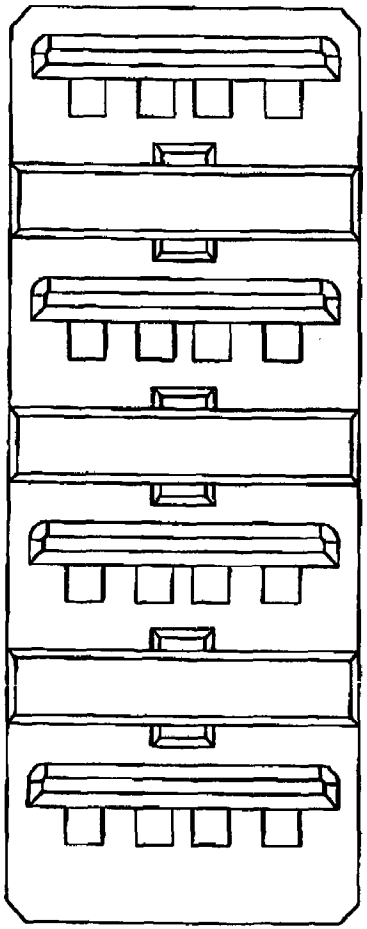
FIG. 10 is a front side view of the housing shown in FIGS. 8 and 9.
Figure 13:
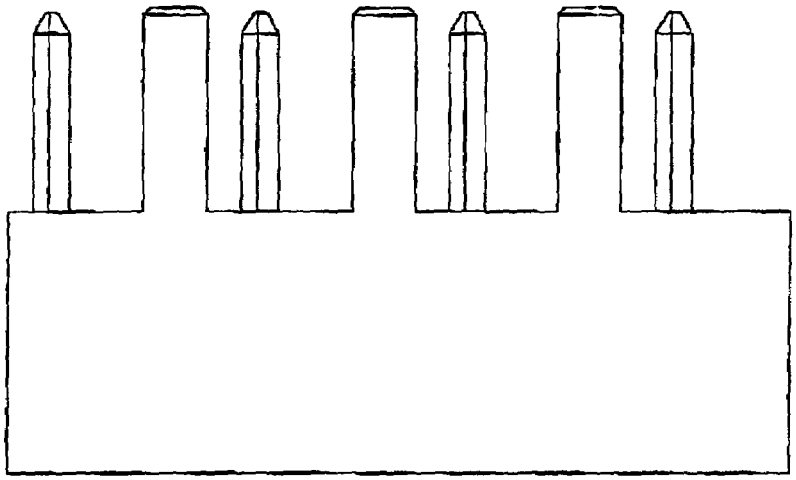
FIG. 13 is a left side view of the housing shown in FIG. 10.
Figure 12:
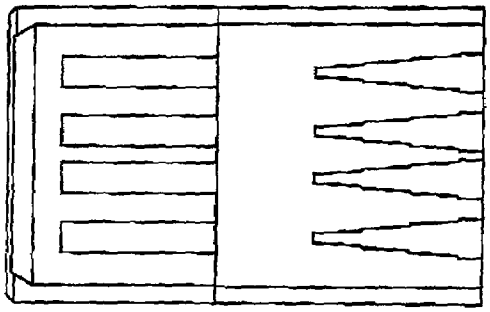
FIG. 12 is a bottom plan view of the housing shown in FIG. 10.
Figure 15:
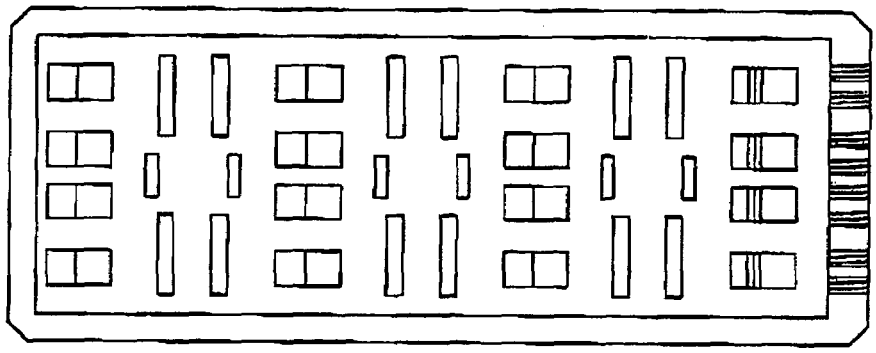
FIG. 15 is a rear side view of the housing shown in FIG. 10.
Figure 14:
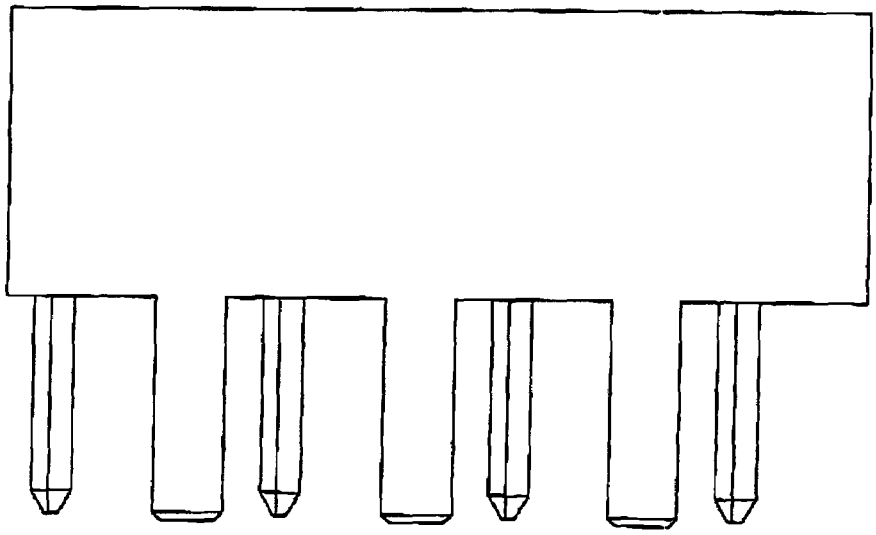
FIG. 14 is a right side view of the housing shown in FIG. 10.
Figure 16:
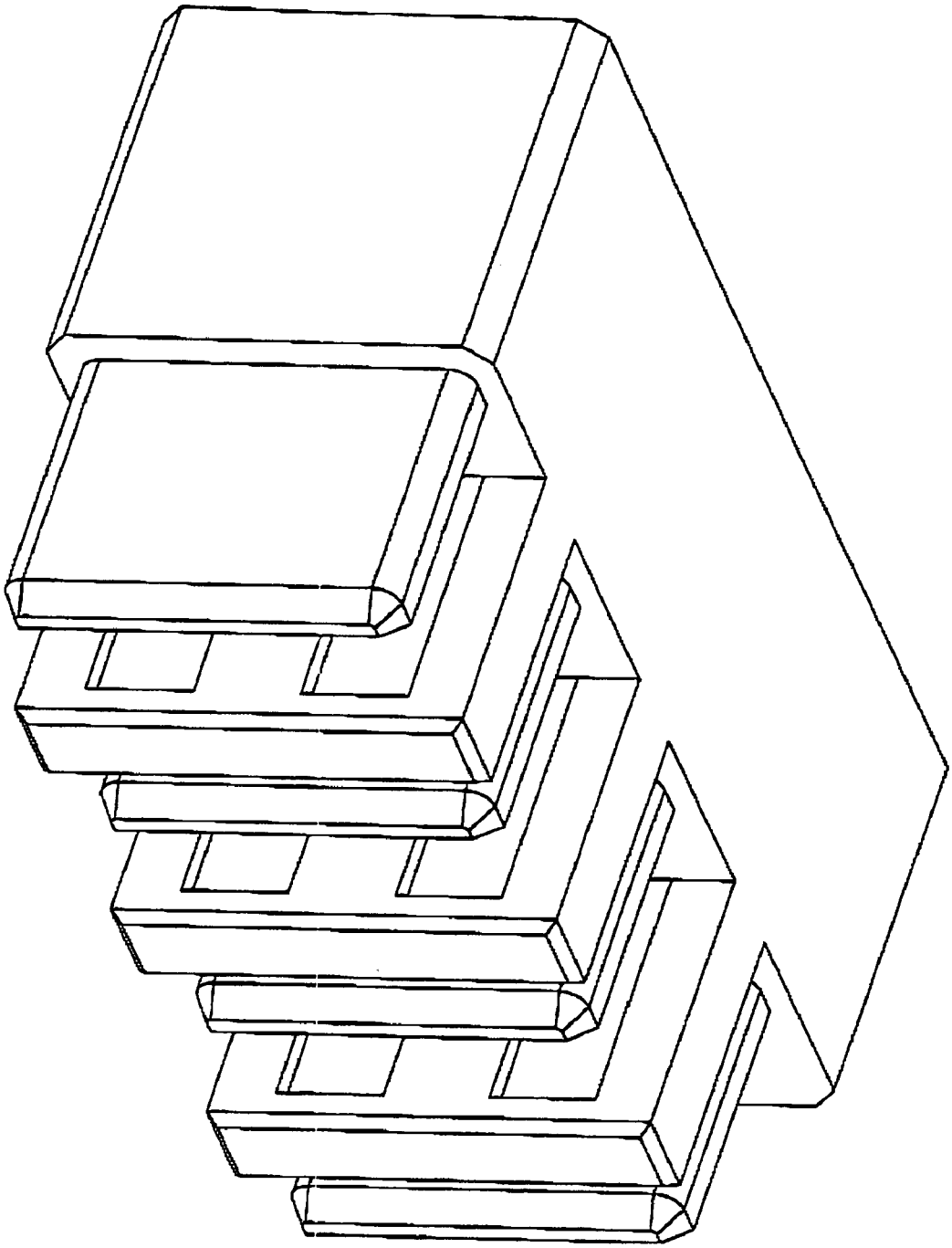
FIG. 16 is a top, front and right side perspective view of the housing shown in FIG. 10.

Referring also to FIG. 9, a perspective view of a subassembly of the electrical connector 10 before the outer shield 16 is attached is shown. The support shelves 22, 24 extend forward from the main section 20 in a general cantilevered fashion. In this embodiment, the housing 12 comprises four of the contact support shelves 22 and three of the inner shield support shelves 24. The three upper USB plug receiving areas 32 are formed by spaces between the upper three contact support shelves 22 and the three inner shield support shelves 24. The bottom USB plug receiving area 32 is formed by the space between the bottom contact support shelf 22 and the bottom side of the outer shield 16.

Figure 17:
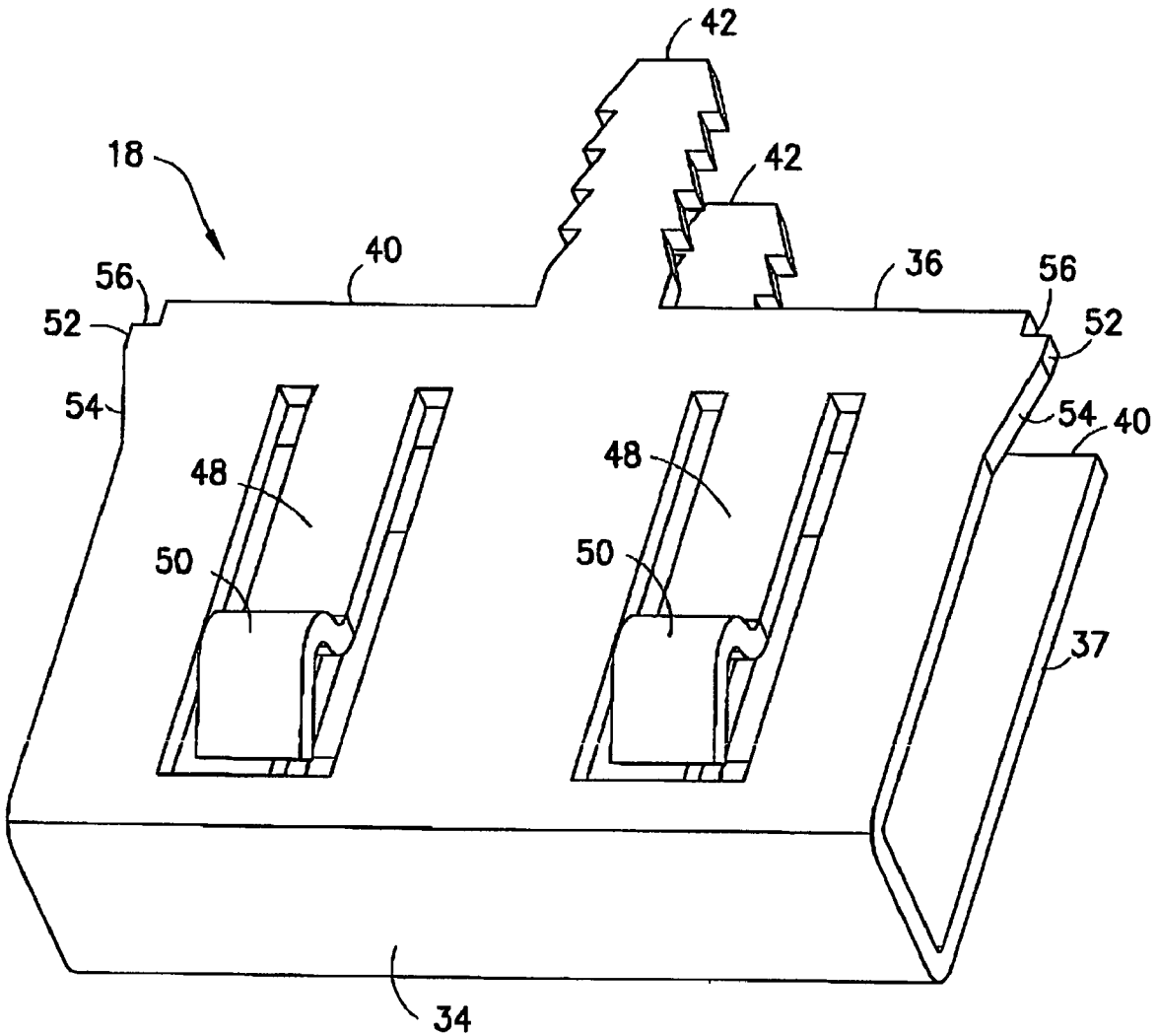
FIG. 17 is a perspective view of one of the inner shields shown in FIGS. 8 and 9.
Figure 18:
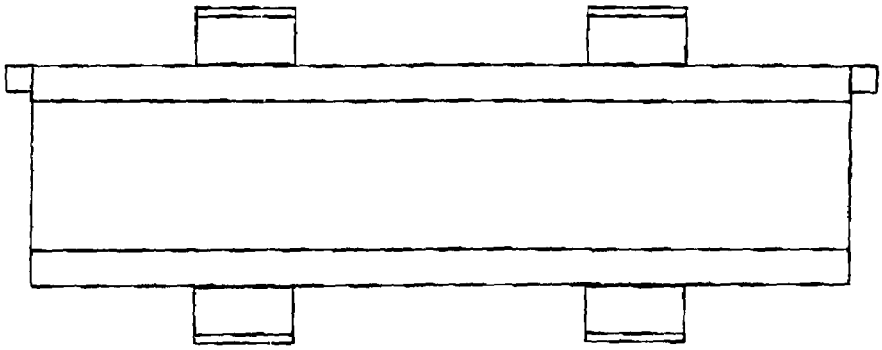
FIG. 18 is a front side view of the inner shield shown in FIG. 17.
Figure 19:
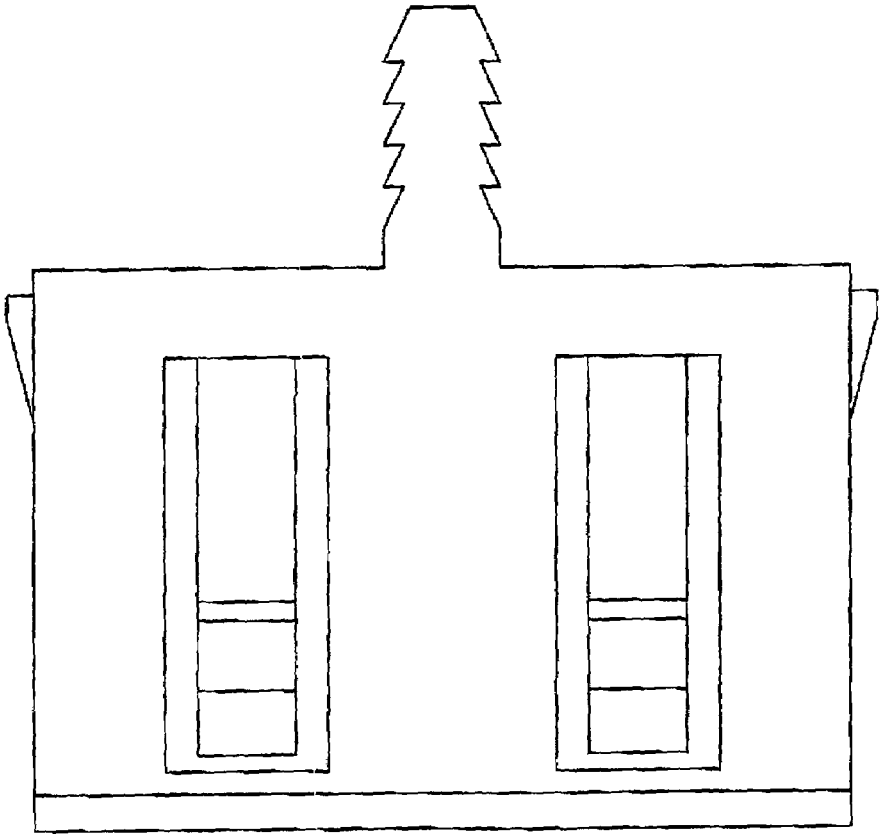
FIG. 19 is a top plan view of the inner shield shown in FIG. 17.
Figure 20:
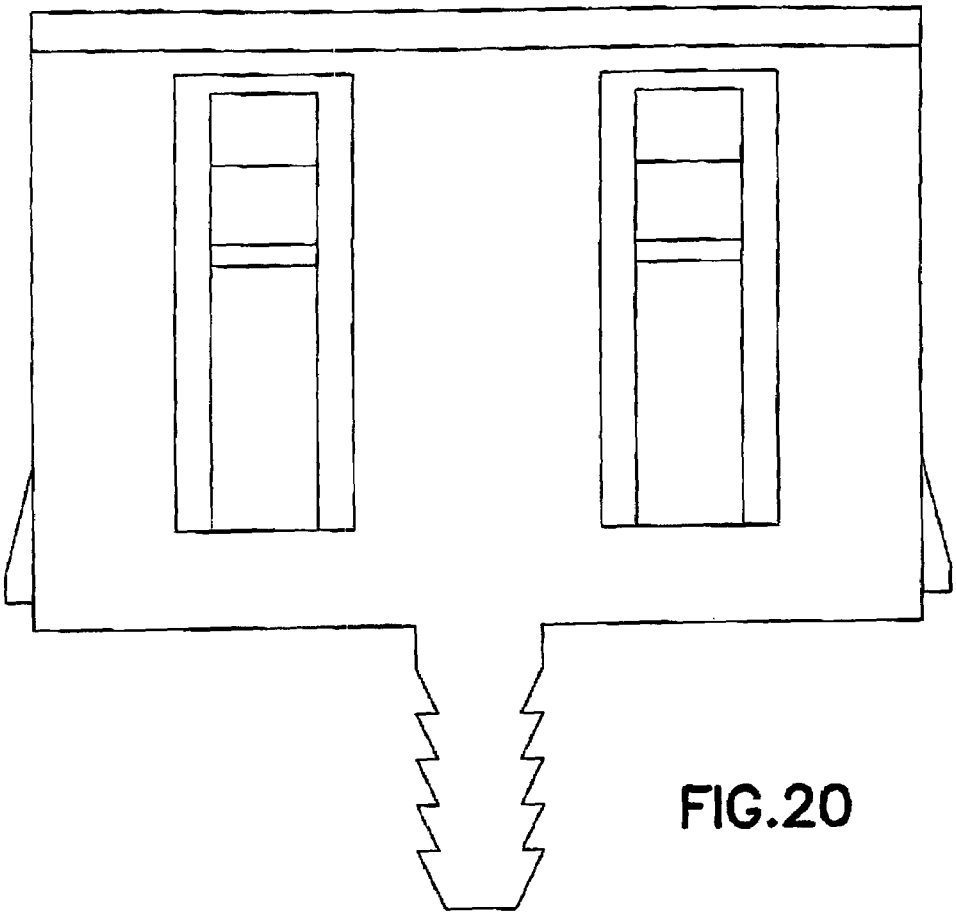
FIG. 20 is a bottom plan view of the inner shield shown in FIG. 17.
Figure 21:
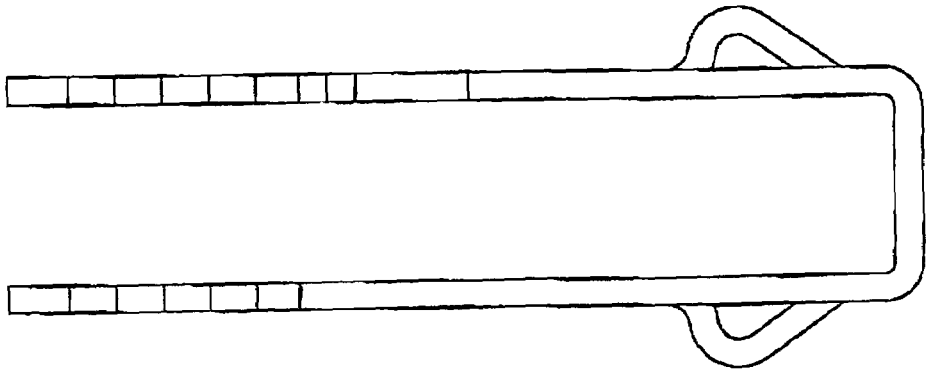
FIG. 21 is a left side view of the inner shield shown in FIG. 17.
Figure 22:
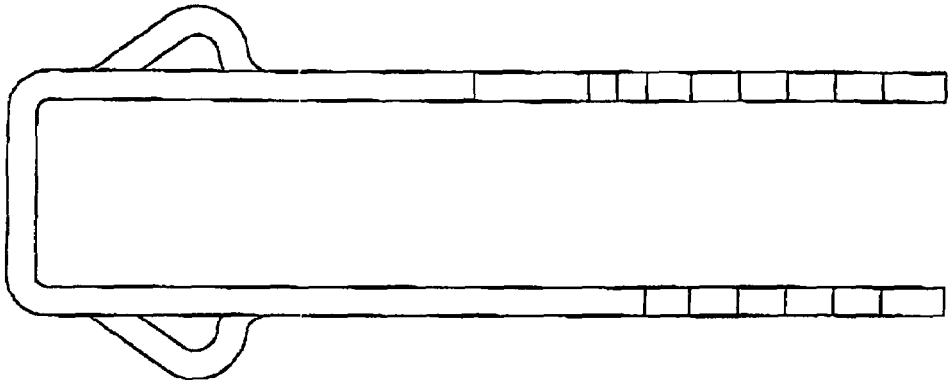
FIG. 22 is a right side view of the inner shield shown in FIG. 17.
Figure 23:
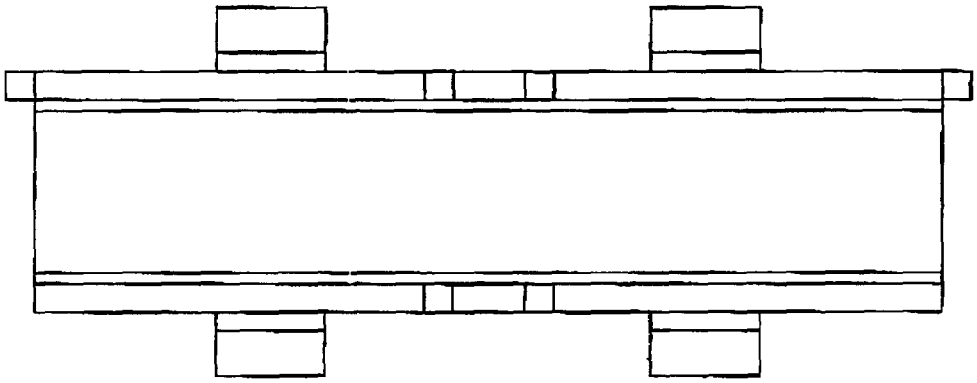
FIG. 23 is a rear side view of the inner shield shown in FIG. 17.

FIG. 17 shows a perspective view of one of the inner shields 18. FIGS. 18–23 show elevational and plan views of all six sides of the inner shield. The inner shield 18 is preferably comprised of a flat sheet metal member which is stamped and formed into the shape shown. The inner shield 18 generally comprises a front end 34 and two legs 36, 37 extending reward from the front end 34. The front end 34 comprises a general C shaped substantially unvarying and uniform shape. In this embodiment, the front of the front and 34 is substantially flat. However, in an alternate embodiment, the front end could be curved. In another alternate embodiment, the shape of the front of the front end might not be unvarying and uniform. Instead, the front of the front end could comprise one or more springs, such as in the prior art. Each leg 36, 37 has a rear end 40. The rear ends 40 each comprise a portion which forms a rearward projection 42. Each projection 42, in the embodiment shown, comprises barbs 44 on opposite lateral sides.

The housing 12 comprises holes 46 (see FIG. 9) which are adapted to receive the projections 42 therein. The holes 46 are located at the top and bottom junctions of the inner shield support shelves 24 with the main section 20. The projections 42 form prongs that extend through the holes in the front vertical wall sections of the main section of the housing. The barbs 44 are adapted to grip into the housing 12 to fixedly retain the inner shield 18 with the housing 12. Thus, the projections 42 form mounting sections for attaching the rear ends of the legs 36, 37 to the housing 12. The projections 42 do not extend past the rear end of the housing 12 and do not make electrical connection with the outer shield 16.

The top and bottom legs 36, 37 also comprise resiliently deflectable arms 48 having contact areas 50. The deflectable arms 48 extend forward from the rear ends 40 of the legs 36, 37. The contact areas 50 extend outward; upward and downward. The top and bottom sides of the inner shield support shelves 24 comprises recesses which allow the deflectable arms 48 to be deflected into the recesses. The front end 34 and legs 36, 37 are sized and shaped to slide onto the front ends of the inner shield support shelves 24 and cover the front portions of the support shelves 24.

The upper leg 36 comprises latch sections 52. In an alternate embodiment, the lower leg could comprise the latch sections, or both the upper and lower legs could comprise latch sections. The latch sections 52 extend laterally outward from the lateral sides of the upper leg 36. The latch sections 52 comprise a general snap lock latch configuration with a forward ramp surface 54 and a rear latch surface 56. The latch sections 52 are adapted to latch into holes 58 in the lateral sides of the outer shield 16 (see FIGS. 1 and 8).

In alternate embodiments, any suitable type of latching system on the rear end of the inner shields to attach to the outer shield could be provided. The width of the inner shields also are preferably the same as the width of the distance between the lateral side walls of the outer shield such that the lateral sides of the inner shields make electrical surface contact with the inner sides of the outer shield's lateral side walls. However, this need not be provided. In other alternate embodiments, any suitable shape of the inner shields could be provided. Preferably, the inner shields can be attached to the housing before the outer shield is connected to the housing, and connection of the inner shields to the outer shields does not require multiple additional connection steps.

Figure 24:
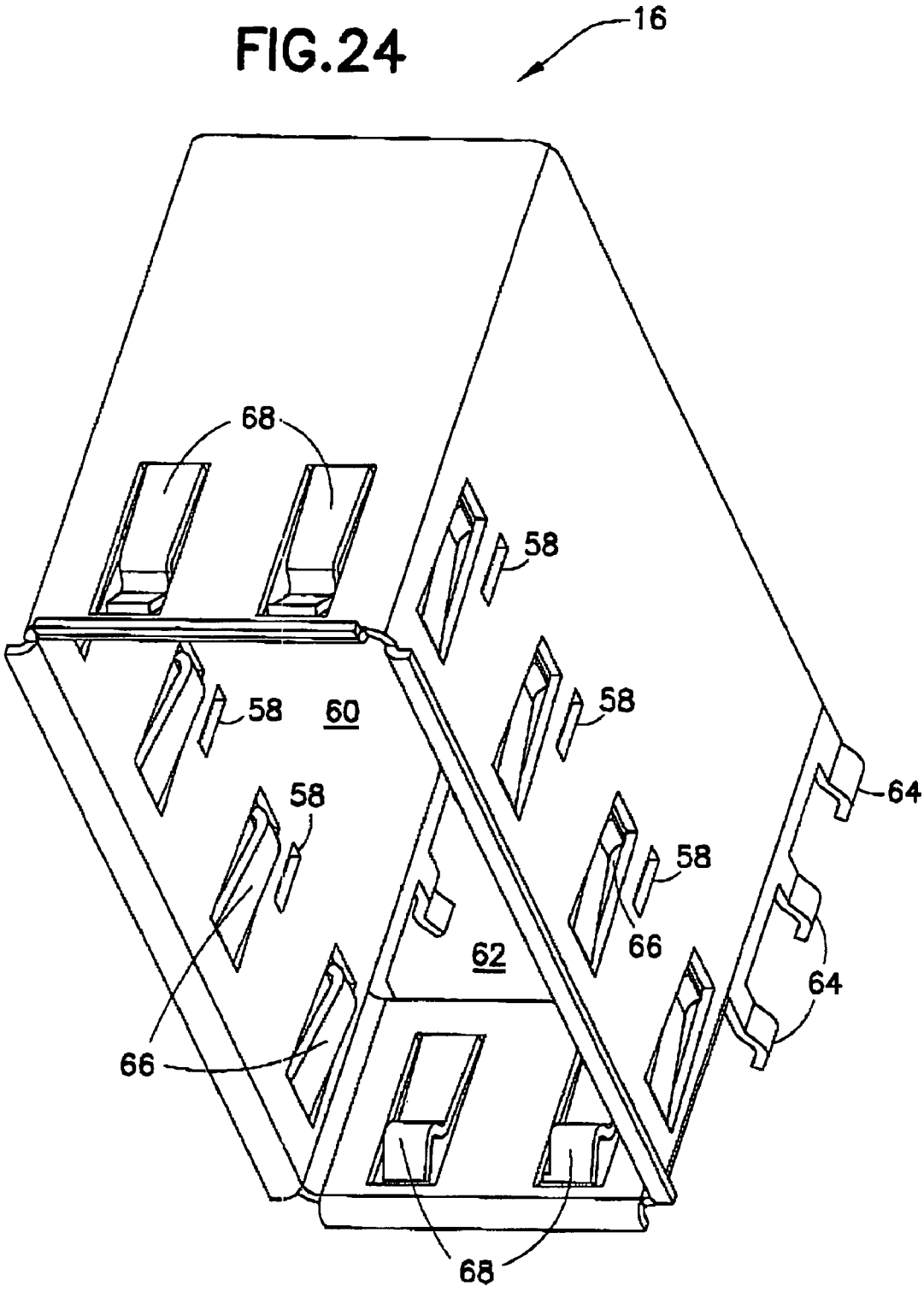
FIG. 24 is a perspective view of the outer shield shown in FIGS. 1 and 8.
Figure 26:
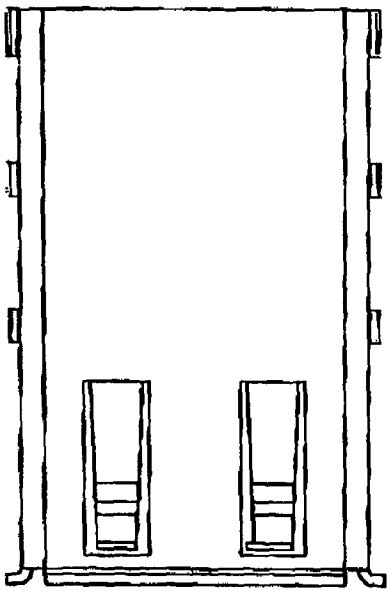
FIG. 26 is a top plan view of the outer shield shown in FIG. 24.
Figure 25:
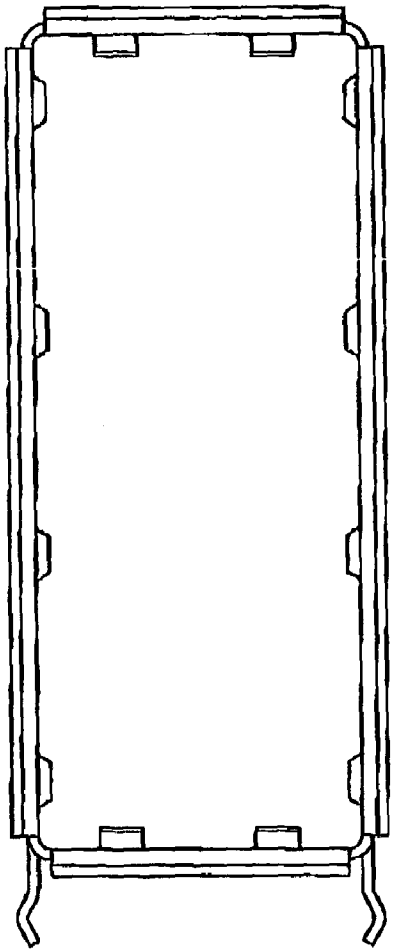
FIG. 25 is a front side view of the outer shield shown in FIG. 24.
Figure 28:
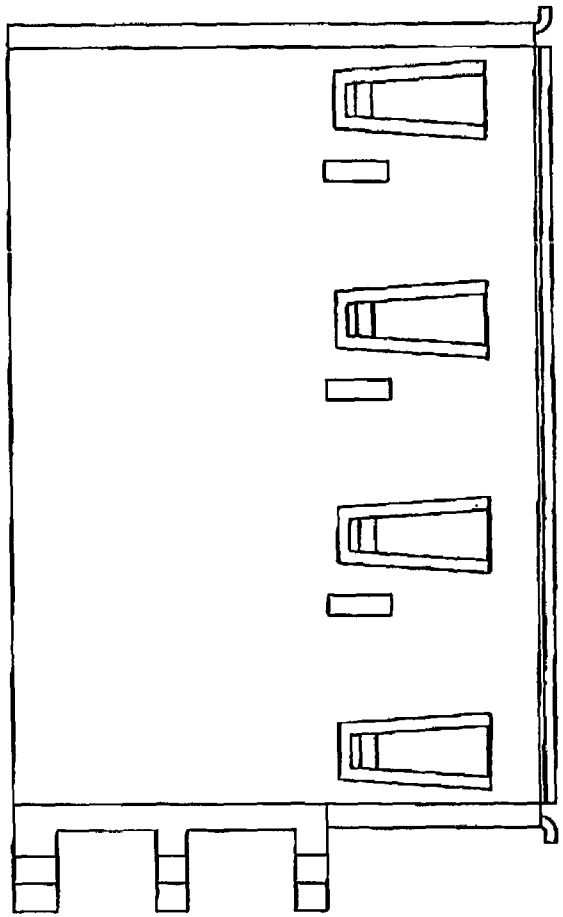
FIG. 28 is a left side view of the outer shield shown in FIG. 24.
Figure 27:
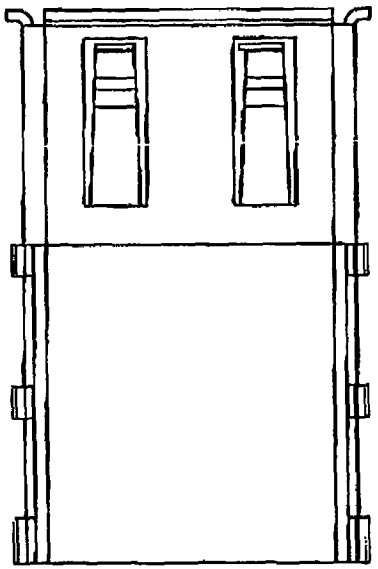
FIG. 27 is a bottom plan view of the outer shield shown in FIG. 24.
Figure 30:
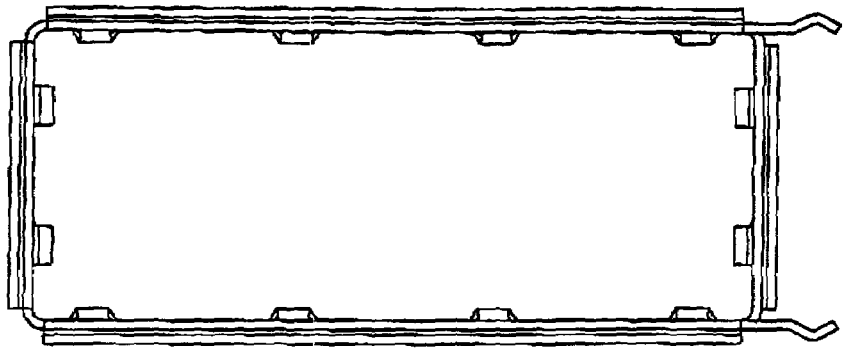
FIG. 30 is a rear side view of the outer shield shown in FIG. 24.
Figure 29:
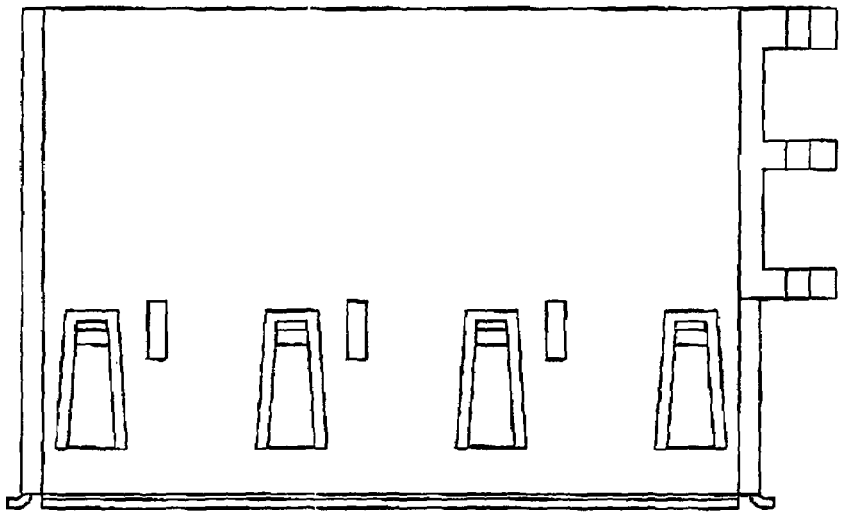
FIG. 29 is a right side view of the outer shield shown in FIG. 24.

FIG. 24 shows a perspective view of the outer shield 16. FIGS. 25–30 show elevational and plan views of all six sides of the outer shield 16. The outer shield 16 is preferably comprised of a sheet metal member which is stamped and formed into the shape shown. The outer shield 16 comprises a center open area 60 which is sized and shaped to receive the housing/contact/inner shield subassembly shown in FIG. 9.

The front side of the outer shield 16 is substantially open. The rear side of the outer shield 16 is substantially open. However, in an alternate embodiment, a portion of the outer shield 16 could be adapted to fold over the open rear side after the housing/contact/inner shield subassembly is inserted into the outer shield 16. The bottom side of the shield 16 has an open section 62 which is adapted to allow a portion of the bottom of the housing 12 to project therethrough. The bottom side of the shield 16 also comprises electrical contact mounts 64 for mechanically attaching the outer shield 16 to another member, such as a printed circuit board, and electrically connect the outer shield 16 to a ground of that electronic component.

The top and bottom sides and the lateral sides of the outer shield 16 comprises inwardly projecting deflectable contact arms 66, 68. The lateral sides of the outer shield 16 also comprise latch holes 58 below the top three lateral contact arms 66. In an alternate embodiment, any suitable size and shape of outer shield could be provided, but the outer shield preferably comprises a means for mechanically and electrically connecting to rear lateral sides of the inner shields.

In a preferred method of assembling the electrical connector 10, the electrical contacts 14 and inner shields 18 are attached to the housing 12 to form a subassembly as shown in FIG. 9. After this subassembly is formed, the subassembly is then inserted through the rear side of the outer shield 16. As the subassembly is inserted into the outer shield 16, the latch sections 52 cause the lateral sides of the outer shield 16 to deflect outward and then snap back to its home position when the latch sections 52 align with the holes 58. Thus, the latch sections 52 and the holes 58 form a snap lock connection between the inner shields 18 and the outer shield 16 to provide a mechanical and electrical connection between the members. Because the inner shields 18 are also mechanically attached to the main section 20 of the housing 12 by the two projections 42, the mechanical connection of the latch sections 52 to the outer shield 16 also mechanically attaches the housing 12 to the outer shield 16 by means of the inner shields 18.

In this embodiment, the front ends of the inner shields 18 are not directly connected to the front end of the outer shield 16. This allows the subassembly shown in FIG. 9 to be relatively easily inserted into the outer shield 16 and connected with the outer shield without extensive additional steps to form the final completed electrical connector. This is faster and much easier than assembly of the USB connector described in U.S. Pat. No. 6,139,367 which requires the inner shells to be inserted from the front, the housing to be inserted from the rear, and the tangs on the front of the inner shells to be deformed to connect the fronts of the inner shells to the outer shell.

Figure 31:
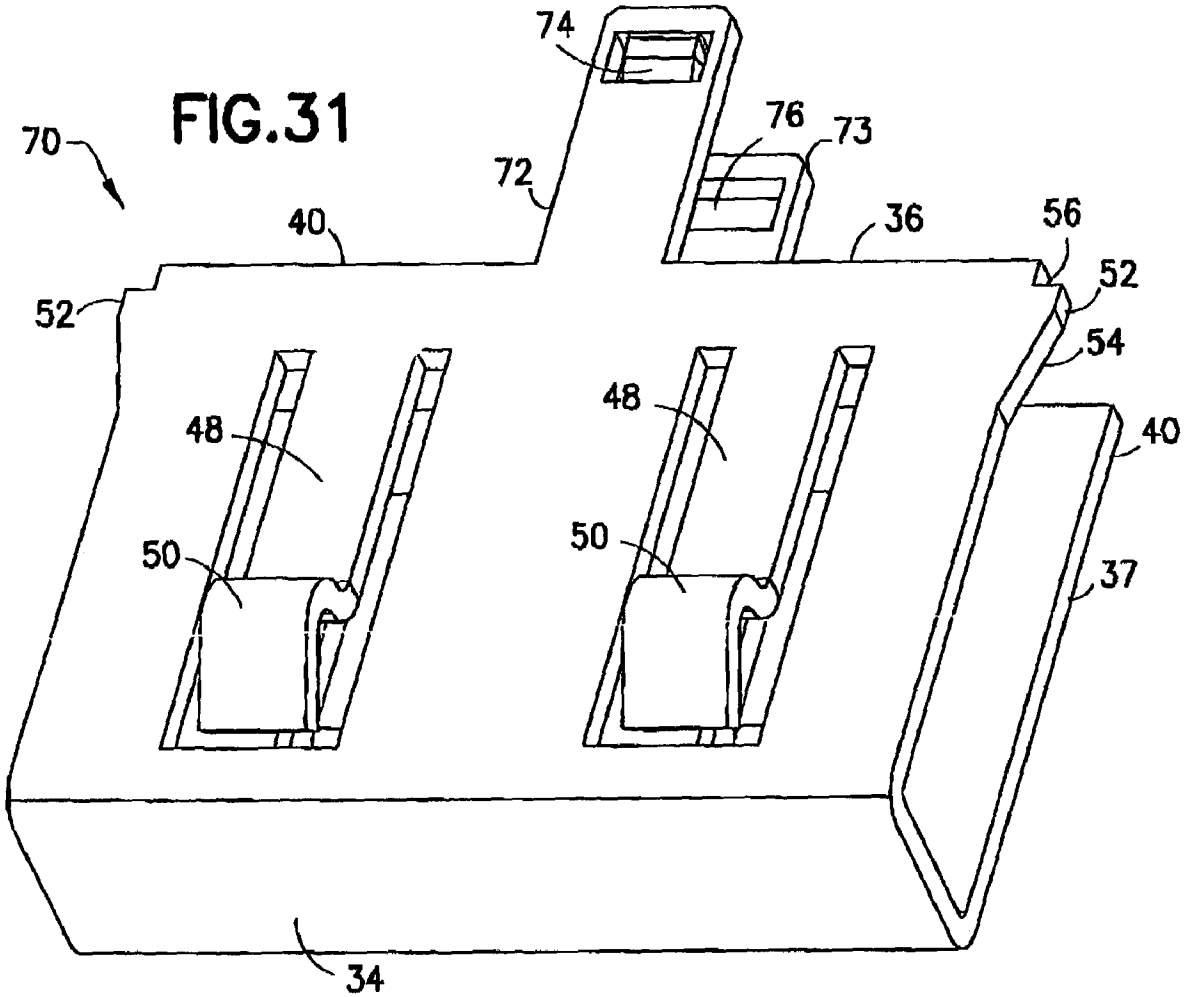
FIG. 31 is a perspective view of an alternate embodiment of the inner shield shown in FIG. 17.
Figure 32:
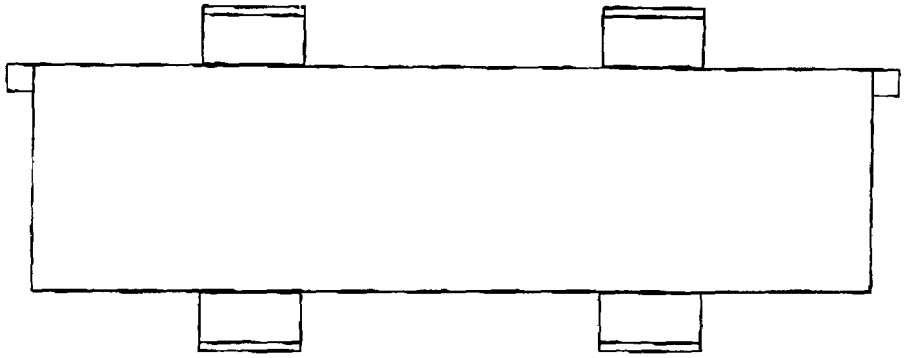
FIG. 32 is a front side view of the inner shield shown in FIG. 31.
Figure 33:
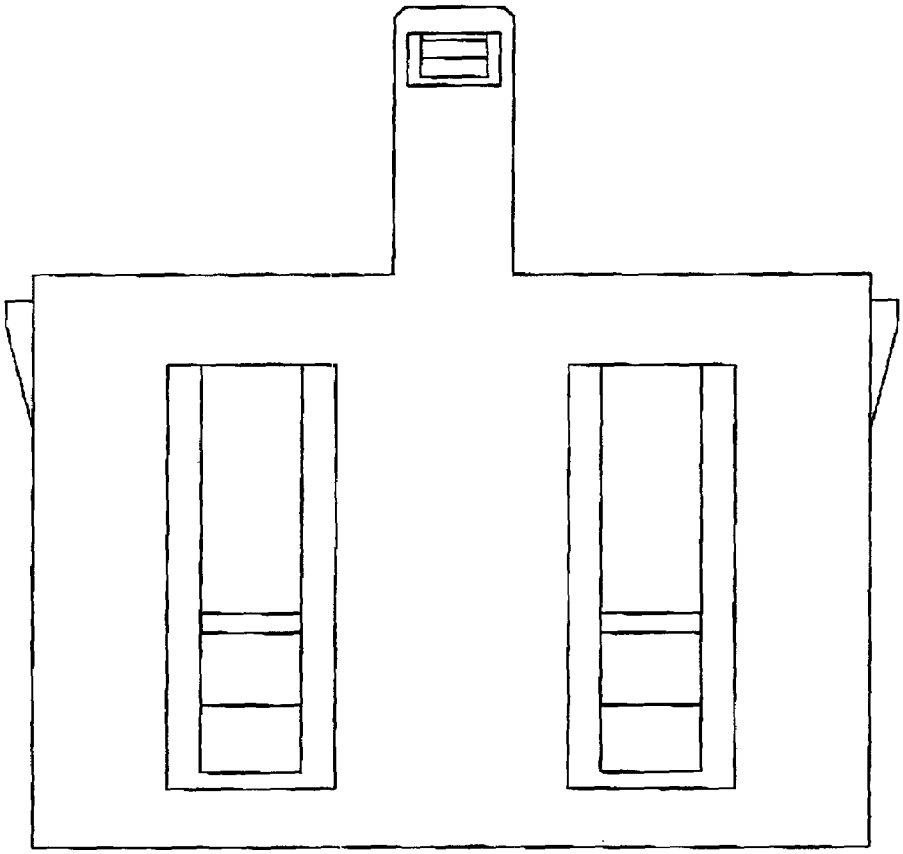
FIG. 33 is a top plan view of the inner shield shown in FIG. 31.
Figure 34:
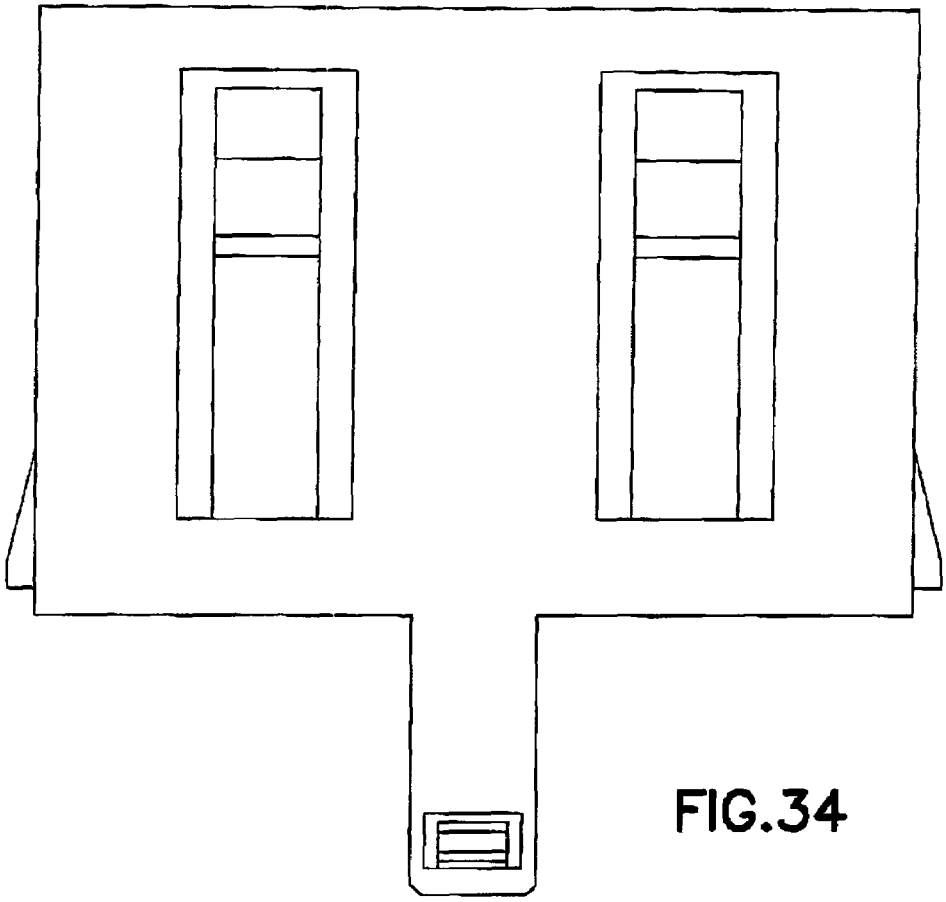
FIG. 34 is a bottom plan view of the inner shield shown in FIG. 31.
Figure 35:
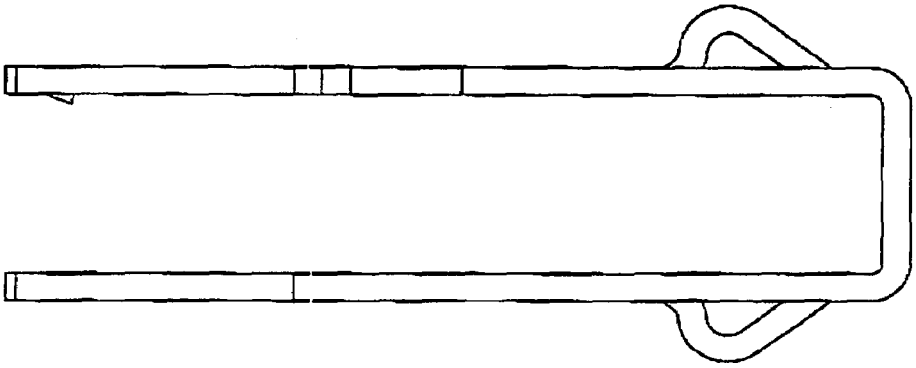
FIG. 35 is a left side view of the inner shield shown in FIG. 31.
Figure 36:
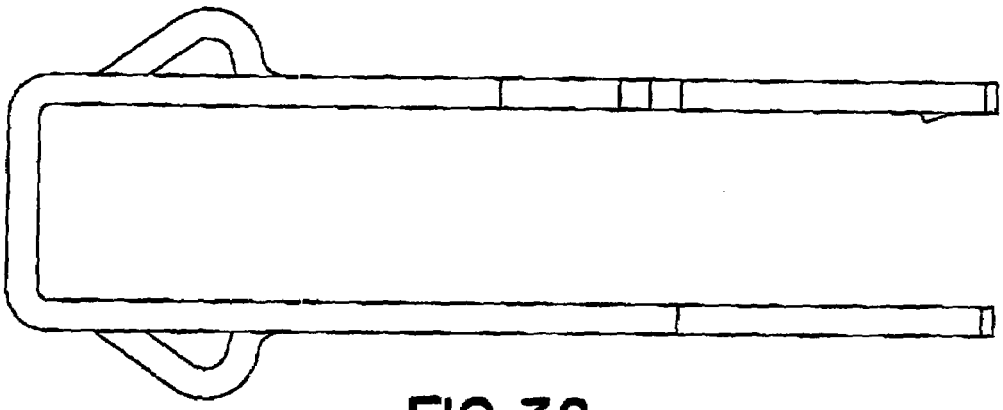
FIG. 36 is a right side view of the inner shield shown in FIG. 31.
Figure 37:
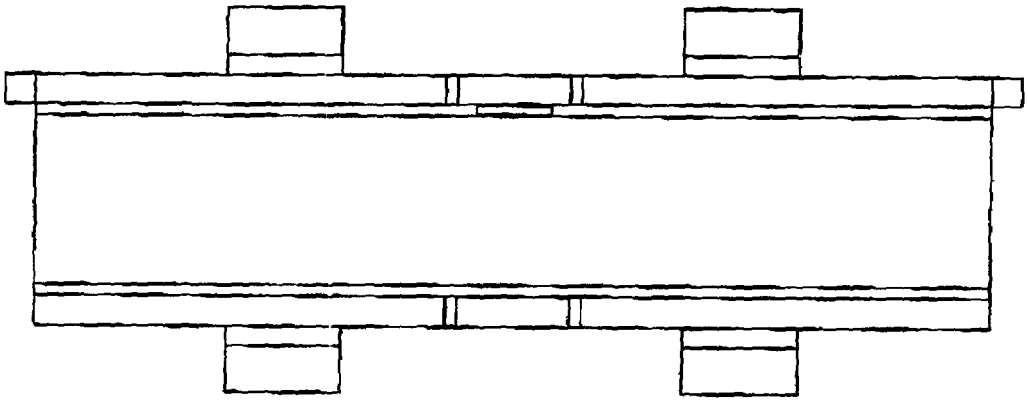
FIG. 37 is a rear side view of the inner shield shown in FIG. 31.

Referring now to FIG. 31, a perspective view of an alternate embodiment of an inner shield 70 is shown. FIGS. 32–37 show elevational and plan views of the inner shield 70 shown in, FIG. 31. The inner shield 70 is substantially identical to the inner shield 18 shown in FIGS. 17–23 with the exception of the rear mounting section projections 72, 73. Thus, similar reference numbers are used for both inner shields 70, 18 for features which are common to both embodiments. The inner shield 70 is preferably comprised of a flat sheet metal member which is stamped and formed into the shape shown. The inner shield 70 generally comprises a front end 34 and two legs 36, 37 extending reward from the front end 34. The front end 34 comprises a general C shaped substantially unvarying and uniform shape. In this embodiment, the front of the front end 34 is substantially flat. However, in an alternate embodiment, the front end could be curved. Each leg 36, 37 has a rear end 40. The rear ends 40 each comprise a portion which forms the rearward projections 72, 73.

Figure 38:
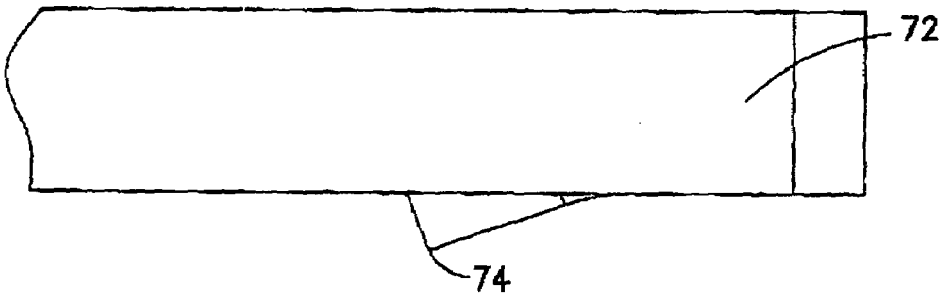
FIG. 38 is an enlarged side view of an end of one of the rear end projections of the inner shield shown in FIG. 31.

The projections 72, 73, in the embodiment shown, do not comprise barbs 44 on opposite lateral sides. Instead, as seen in FIG. 38, the upper leg projection 72 comprises an inwardly extending lance or barb 74. The lower leg projection 73 comprises a hole 76. The housing 12 comprises holes 46 (see FIG. 9) which are adapted to receive the projections 72, 73 therein. The holes 46 are located at the top and bottom junctions of the inner shield support shelves 24 with the main section 20. The projections 72, 73 do not extend past the rear end of the housing 12 and do not make electrical connection with the outer shield 16. The two projections 72, 73 are adapted to be inserted into the holes 46 of the housing's main section 20. The barb 74 is adapted to pierce into the housing 12 to retain the inner shield 70 with the housing 12. The housing 12 could comprise a projection inside the hole 46 which receives the lower leg projection 73 which can extend into the hole 76. This could also retain the inner shield 70 with the housing 12.

The top and bottom legs 36, 37 also comprise resiliently deflectable arms 48 having contact areas 50. The deflectable arms 48 extend forward from the rear ends 40 of the legs 36, 37. The top and bottom sides of the inner shield support shelves 24 comprises recesses which allow the deflectable arms 48 to be deflected into the recesses. The front end 34 and legs 36, 37 are sized and shaped to slide onto the front ends of the inner shield support shelves 24 and cover the front portions of the support shelves 24.

The upper leg 36 comprises latch sections 52. In an alternate embodiment, the lower leg could comprise the latch sections, or both the upper and lower legs could comprise latch sections. The latch sections 52 extend laterally outward from the lateral sides of the upper leg 36. The latch sections 52 comprise a general snap lock latch configuration with a forward ramp surface 54 and a rear latch surface 56. The latch sections 52 are adapted to latch into holes 58 in the lateral sides of the outer shield 16 (see FIGS. 1 and 8).

Figure 39:
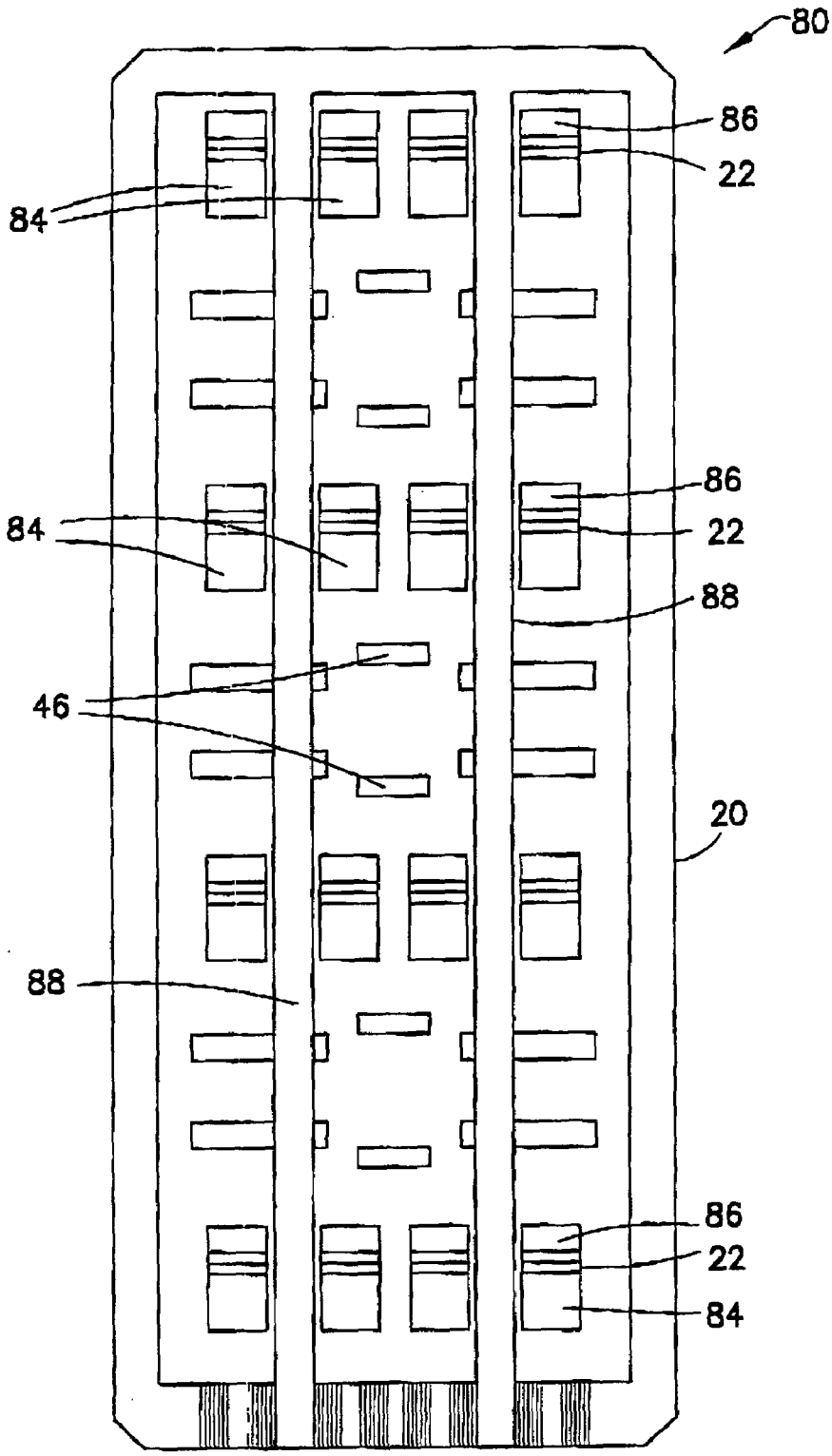
FIG. 39 is a rear side view of an alternate embodiment of the housing shown in FIG. 10.
Figure 41:
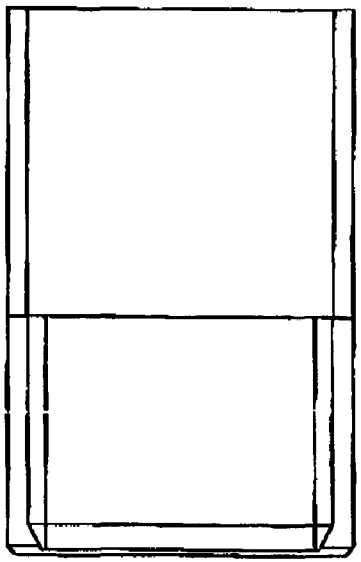
FIG. 41 is a top plan view of the housing shown in FIG. 39.
Figure 40:
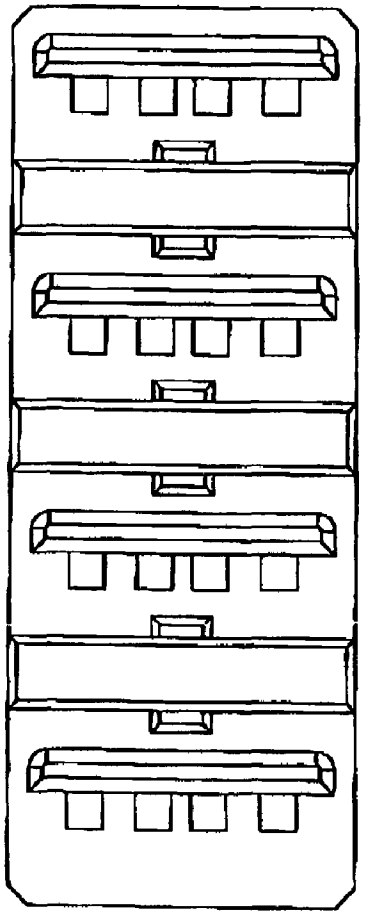
FIG. 40 is a front side view of the housing shown in FIG. 39.
Figure 43:
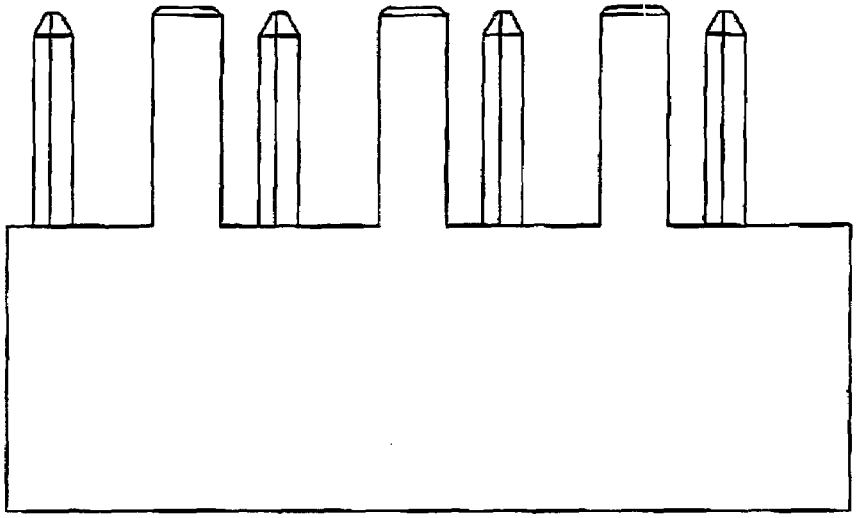
FIG. 43 is a left side view of the housing shown in FIG. 39.
Figure 42:
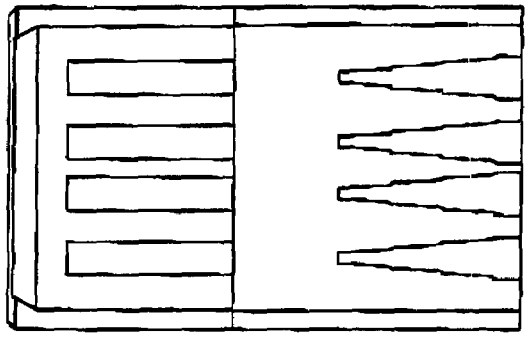
FIG. 42 is a bottom plan view of the housing shown in FIG. 39.
Figure 45:
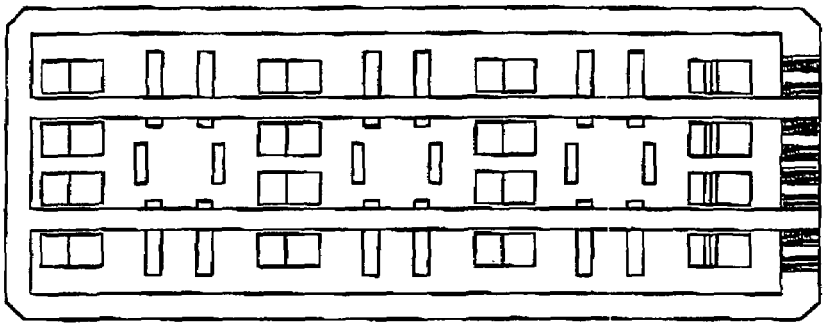
FIG. 45 is a rear side view of the housing shown in FIG. 39.
Figure 44:
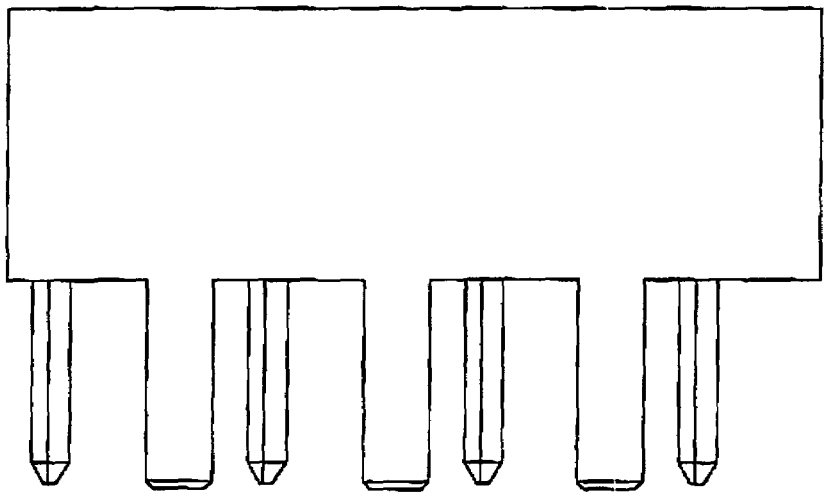
FIG. 44 is a right side view of the housing shown in FIG. 39.

FIG. 39 shows a rear side elevational view of an alternate embodiment of the housing 80. FIGS. 40–45 show elevational and plan views of the housing 80 shown in FIG. 39. The housing 80 is substantially identical to the housing 12 with the exception of the rear side. Thus, similar reference numbers are used for both housings 80, 12 for features which are common to both embodiments.

The housing 80 is preferably a one-piece molded plastic or polymer member. However, in alternate embodiments, the housing could be comprised of more than one member. The housing 80 generally comprises a main section 20, contact support shelves, and inner shield support shelves. The main section 20 comprises a relatively open rear side 82 which is adapted to house the vertical sections of the electrical contacts 14. The bottom ends of the electrical contacts 14 extend outward from the bottom end of the main section 20. The main section 20 also comprises holes 84. The holes 84 extend through the main section to bottom sides of the contact support shelves 22. The contact support shelves 22 comprises contact grooves or channels 86 which the upper legs of the electrical contacts 14 are located in. The deflectable contact sections 30 of the electrical contacts 14 extend downward from the bottom sides of the contact support shelves 22. Front ends of the contact sections 30 can be preloaded against portions of the contact support shelves 22. The housing 80 comprises the holes 46 for receiving the projections of the inner shields. In this embodiment, the rear side end 82 of the housing 80 also comprises longitudinal ribs 88. The ribs 88 strengthen and stiffen the housing 80. The ribs 88 can also separate at least some of the columns of electrical contacts 14 from each other.

As noted above, features of the present invention could be used in a 2-by-X USB electrical connector having two side-by-side columns of two or more (X) USB plug receiving areas (such as 2-by-2, or 2-by-3, or 2-by-4, etc.). Because the inner shields are fixedly and stationarily attached to the housing, there is no need to provided a stationary attachment of the inner shields to the outer shield; they can move relative to each other, but preferably maintain an electrical connection with each other. Thus, the present invention can allow the front ends of the inner shields to not need to be directly connected to the front of the outer shield; allowing for better tolerances and easier assembly. In addition, the block-like or clip-like shape of the inner shields (closed front end, and substantially closed top and bottom legs) still provides excellent shielding between groups of signal contacts in the stack. The clip-like shape of the inner shields can also assist in providing a clamping of the inner shield on the support shelves 24 (between the two legs 36, 37) to attach and retain the inner shields on the housing.

Figure 47:
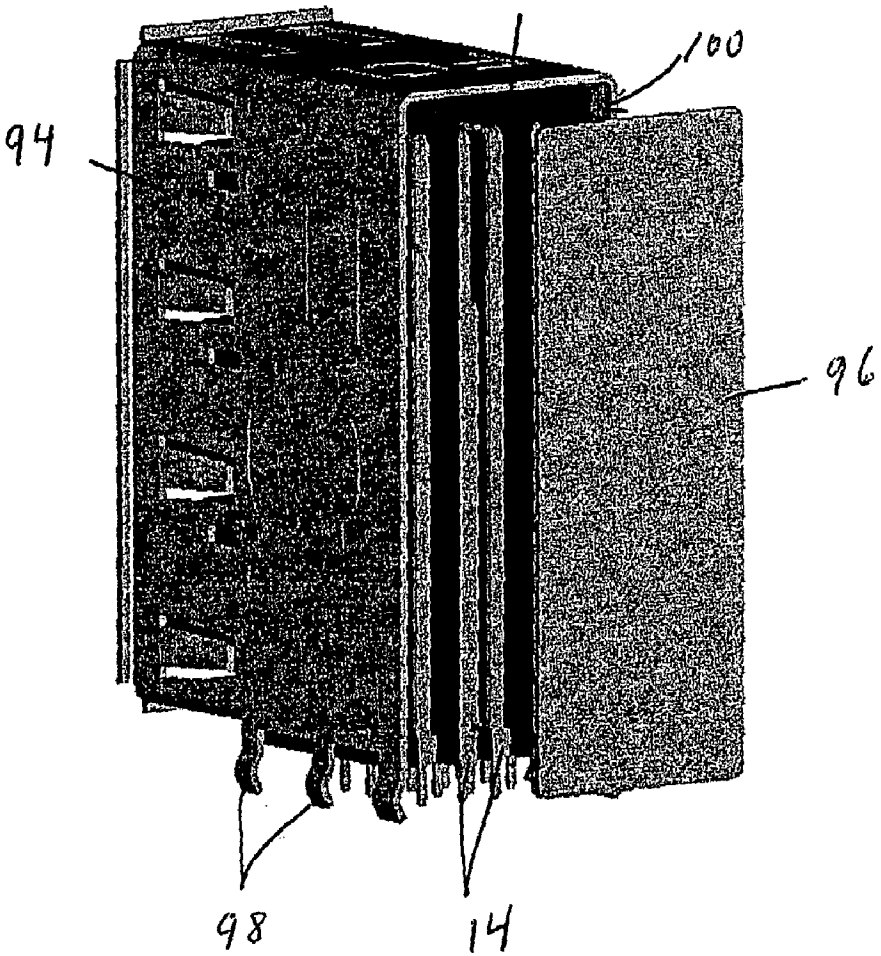
FIG. 47 is a partially exploded perspective view of the connector shown in FIG. 46 with the rear shield moved away from the rest of the connector for illustration purposes.
Figure 46:
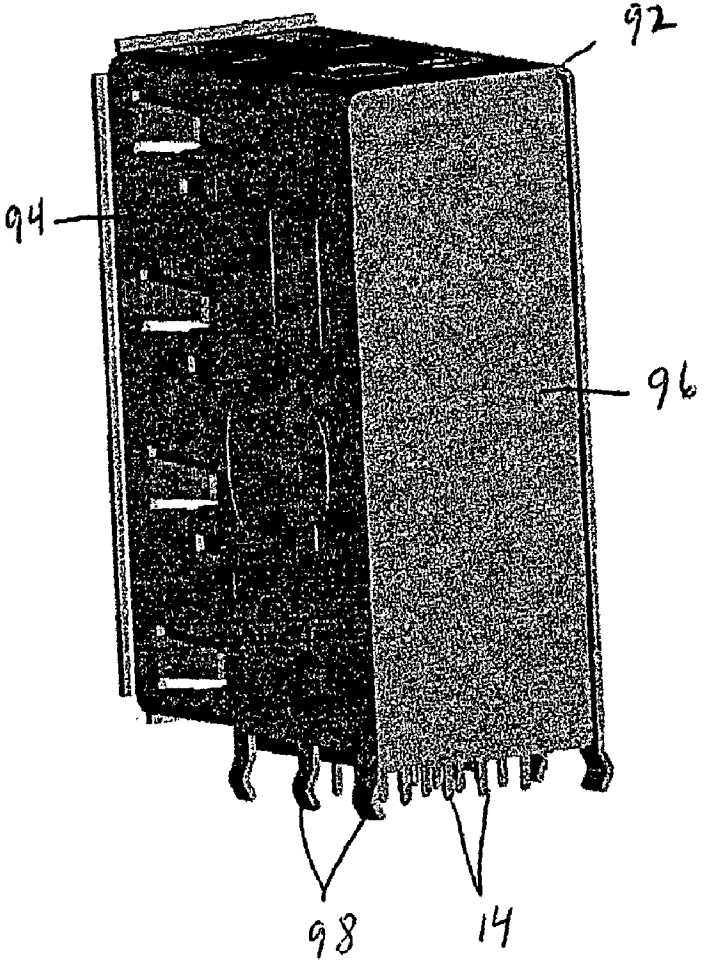
FIG. 46 is a perspective view showing the rear side of an alternate embodiment of the present invention.

Referring to FIGS. 46 and 47, an alternate embodiment of the electrical connector is shown. In this embodiment the electrical connector 90 is identical to the electrical connector 10 except for the outer shield 92. The outer shield 92 comprises a first member 94 and a second member 96. The first and second members are both comprised of electrically conductive material and are electrically coupled to each other. The first member 94 covers the top side and the two lateral sides of the housing 12. The first member 94 also comprises solder tails 98. The rear side of the first member 94 has an opening 100 which is adapted to receive the second member 96 therein. Thus, the second member 96 can be attached to the first member 94 after the first member is attached to the housing 12. In alternate embodiments, the outer shield could comprise more than two shield members.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector comprising:

a housing that defines a front side, a main section, an inner shield support shelf that extends from the main section, and a bottom side;

electrical contacts connected to the housing;

an outer shield connected to the housing; and at least one inner shield inserted onto the inner shield support shelf from a front side of the housing, wherein the inner shield defines a C shape that comprises a flat front end and two legs extending reward from the front end, wherein lateral sides of the front end are straight and form straight opposite edges of the front end, wherein each leg comprises a rear end with a multiple barbed portion which extends into the main section of the housing to attach the rear end of the at least one inner shield to the housing, and wherein the front end of the inner shield is not directly mechanically attached to a front of the outer shield.

2. An electrical connector as in claim 1 wherein the electrical connector comprises three of the inner shields and the housing is adapted to receive four universal serial bus (USB) plug connectors.

3. An electrical connector as in claim 1 wherein the two rearward extending legs each comprise cantilevered deflectable contact arms extending outward from the legs.

4. An electrical connector as in claim 3 wherein the contact arms extend forward from the rear ends of the legs.

5. An electrical connector as in claim 1 wherein the portion of the inner shield which extends into the housing comprises barbs for gripping into the housing.

6. An electrical connector as in claim 1 wherein the portion of the inner shield which extends into the housing comprises an inward extending barb.

7. An electrical connector as in claim 1 wherein a first one of the legs comprises laterally outward projecting latch sections at the rear end of the first leg which extend into holes in the outer shield to electrically and mechanically connect the inner shield to the outer shield.

8. An electrical connector comprising:

a housing that defines a front side, a main section, an inner shield support shelf that extends from the main section, and a bottom side;

electrical contacts connected to the housing;

an outer shield connected to the housing; and at least one inner shield mounted along a portion of a front side of the housing, wherein the inner shield defines a C shape comprising a front end and two legs extending reward from the front end, wherein lateral sides of the front end are straight and form straight opposite edges of the front end, wherein each leg comprises a rear end with a multi-barbed mounting section for attaching the rear end to the housing, and wherein a first one of the legs comprises rigid, laterally outward projecting latch sections at the rear end of the first leg which extend into holes in the outer shield to electrically and mechanically connect the inner shield to the outer shield.

9. An electrical connector as in claim 8 wherein the front end of the inner shield is not directly mechanically attached to a front of the outer shield.

10. An electrical connector as in claim 8 wherein the electrical connector comprises three of the inner shields and the housing is adapted to receive four universal serial bus (USB) plug connectors.

11. An electrical connector as in claim 8 wherein the two rearward extending legs each comprise cantilevered deflectable contact arms extending outward from the legs.

12. An electrical connector as in claim 11 wherein the contact arms extend forward from the rear ends of the legs.

13. An electrical connector as in claim a wherein the mounting section of the inner shield extends into the housing and comprises barbs on opposite sides of the portion for gripping into the housing.

14. An electrical connector as in claim 8 wherein the portion of the inner shield which extends into the housing comprises an inward extending barb.

15. An electrical connector as in claim 8 wherein the latch sections comprise a forward ramp surface and a rear latch surface, and wherein a second one of the legs does not comprise a latch section such that only the first leg latches to the outer shield.

16. An electrical connector comprising:

a housing;

electrical contacts connected to the housing;

an outer shield connected to the housing; and at least one inner shield mounted along a portion of a front side of the housing, wherein the inner shield comprises a general C shaped substantially unvarying and uniform front end and two legs extending reward from the front end, wherein each leg comprises a rear end with a single projection which extends into the housing to attach the rear end to the housing, wherein each projection comprises multiple barbs on each lateral side of each projection, wherein only a first one of the legs comprises laterally outward projecting latch sections at the rear end of the first leg which extend into holes in the outer shield to electrically and mechanically connect the inner shield to the outer shield, and wherein each latch section comprise a forward ramp surface and a rear latch surface.

17. An electrical connector as in claim 16 wherein the electrical connector comprises three of the inner shields and the housing is adapted to receive four universal serial bus (USB) plug connectors.

18. An electrical connector as in claim 16 wherein the two rearward extending legs each comprise cantilevered deflectable contact arms extending outward from the legs.

19. An electrical connector as in claim 16 wherein the projection of the inner shield which extends into the housing comprises barbs for gripping into the housing.

20. An electrical connector as in claim 16 wherein the projection of the inner shield which extends into the housing comprises an inward extending barb.

21. An electrical connector as in claim 16 wherein the front end of the inner shield is not directly mechanically attached to a front of the outer shield.

22. A method of assembling an electrical connector comprising:

inserting electrical contacts into a rear side of a housing;

mounting an inner shield onto an inner shield support shelf of the housing from a front side of the housing, wherein the inner shield comprises a general C shaped front end and two legs extending reward from the front end, wherein a rigid latch section that extends laterally and outwardly from one of the two legs, and a multi-barb section that extends through the housing;

inserting the housing, with the inner shield attached to the housing, into a rear end of an outer shield; and attaching the rigid latch section into a hole in a lateral side of the outer shield to mechanically and electrically attach the inner shield to the outer shield without directly attaching a front end of the inner shield to a front end of the outer shield.

* * * * *

UNITED STATES PATENT AND TRADEMARK OFFICE

CERTIFICATE OF CORRECTION

PATENT NO. : 7,081,017 B2
APPLICATION NO. : 10/894743
DATED : July 25, 2006
INVENTOR(S) : Joseph B. Shuey et al.

It is certified that error appears in the above-identified patent and that said Letters Patent is hereby corrected as shown below:

IN THE CLAIMS:

In Claim 1,Column 8, line 61 please delete “reward” and replace with --rearward--.

In Claim 8,Column 9, line 32 please delete “reward” and replace with --rearward--.

In Claim 13,Column 9, line 53 delete “a” and insert --8--.

In Claim 16, Column 10, line 13 please delete “reward” and replace with --rearward--.

In Claim 22, Column 10, line 47 please delete “reward” and replace with --rearward--.

Signed and Sealed this

Thirty-first Day of October, 2006

JON W. DUDAS
*Director of the United States Patent and Trademark Office*